US008545067B2

(12) United States Patent
Espiau

(10) Patent No.: US 8,545,067 B2
(45) Date of Patent: Oct. 1, 2013

(54) SMALL FORM FACTOR DURABLE STREET LAMP AND METHOD

(75) Inventor: Frederick M. Espiau, Topanga, CA (US)

(73) Assignee: Topanga Technologies, Inc., Canoga Park, CA (US)

( * ) Notice: Subject to any disclaimer, the term of this patent is extended or adjusted under 35 U.S.C. 154(b) by 159 days.

(21) Appl. No.: 12/720,619

(22) Filed: Mar. 9, 2010

(65) Prior Publication Data

US 2012/0014109 A1 Jan. 19, 2012

Related U.S. Application Data

(60) Provisional application No. 61/158,618, filed on Mar. 9, 2009.

(51) Int. Cl.
*F21S 13/10* (2006.01)

(52) U.S. Cl.
USPC ..... 362/431

(58) Field of Classification Search
USPC ..... 362/431
See application file for complete search history.

(56) References Cited

U.S. PATENT DOCUMENTS 4,774,637 A * 9/1988 Budde et al. ..... 362/548
4,975,655 A 12/1990 Dawson et al.
5,615,947 A * 4/1997 Shambo et al. ..... 362/376
5,637,963 A 6/1997 Inoue et al.
5,686,793 A 11/1997 Turner et al.
5,708,331 A * 1/1998 Vamvakas et al. ..... 315/248
5,777,857 A 7/1998 Degelmann
5,834,895 A 11/1998 Dolan et al.
5,838,108 A 11/1998 Frank et al.
5,886,480 A 3/1999 Penzenstadler et al.
5,923,122 A 7/1999 Frank et al.
6,137,237 A 10/2000 MacLennan et al.
6,241,369 B1 6/2001 Mackiewicz
6,617,806 B2 9/2003 Kirkpatrick et al.
6,737,809 B2 5/2004 Espiau et al.
6,922,021 B2 7/2005 Espiau et al.
7,119,641 B2 10/2006 Petrov et al.
7,291,785 B2 11/2007 Riester et al.
7,348,732 B2 3/2008 Espiau et al.

(Continued)

OTHER PUBLICATIONS

Notice of Allowance for U.S. Appl. No. 12/484,933, mailed on Jul. 23, 2010, 6 pages.

(Continued)

*Primary Examiner* — Julie Shallenberger
(74) *Attorney, Agent, or Firm* — Kilpatrick Townsend & Stockton LLP

(57) ABSTRACT

A shock resistant outdoor lamp has a bulb assembly includes a shock resistant gas-filled vessel coupled to an RF source. The vessel has a transparent or translucent body having an inner surface and an outer surface and a cavity formed within the inner surface. The gas-filled vessel comprises a first end region and a second end region. The bulb assembly has a length provided between the first end region and the second end region and ranging from about 0.5 centimeter to about three centimeters characterizing the gas-filled vessel. The bulb assembly at least one or more coupling members operably coupled to the gas-filled vessel such that the outer surface of the gas-filled vessel is substantially free from mechanical damage caused with the one or more coupling members and substantially free from any openings in the thickness.

19 Claims, 19 Drawing Sheets

(56) References Cited

U.S. PATENT DOCUMENTS

| | | | |
|---|---|---|---|
| 7,350,936 | B2 | 4/2008 | Ducharme et al. |
| 7,358,678 | B2 | 4/2008 | Espiau et al. |
| 7,362,054 | B2 | 4/2008 | Espiau et al. |
| 7,362,055 | B2 | 4/2008 | Espiau et al. |
| 7,362,056 | B2 | 4/2008 | Espiau et al. |
| 7,372,209 | B2 | 5/2008 | Espiau et al. |
| 7,391,158 | B2 | 6/2008 | Espiau et al. |
| 7,719,195 | B2 | 5/2010 | DeVincentis et al. |
| 7,830,092 | B2 | 11/2010 | Espiau et al. |
| 2006/0250090 | A9 | 11/2006 | Guthrie et al. |
| 2008/0054813 | A1 | 3/2008 | Espiau et al. |
| 2009/0322240 | A1 | 12/2009 | Espiau et al. |

OTHER PUBLICATIONS

Bogaerts, et al., "Gas Discharge Plasmas and their Applications," Spectrochimica Acta, Part B 57, 2002, pp. 609-658.

International Search Report and Written Opinion of PCT Application No. PCT/US2009/048174, dated Aug. 17, 2009, 17 pages total.

* cited by examiner

SMALL FORM FACTOR DURABLE STREET LAMP AND METHOD

CROSS-REFERENCES TO RELATED APPLICATIONS

This application claims priority to U.S. Provisional Application No. 61/158,6181, filed on Mar. 9, 2009, commonly assigned, and incorporated by reference herein for all purpose. This application is also related to U.S. patent application Ser. No. 12/484,933, filed on Jun. 15, 2009, now U.S. Pat. No. 7,830,092, and PCT Application Serial No. PCT/US2009/048171, filed on Jun. 22, 2009, commonly assigned, and incorporated by reference herein for all purposes.

BACKGROUND OF THE INVENTION

The present invention relates generally to lighting techniques. More particularly, the present invention provides a method and device using a plasma lighting device having a small form factor and durability for indoor and more preferably street lamp applications in high crime rate regions or other regions that lead to breakage or damage of convention street lamps. Merely by way of example, the street lamp applications can include various configurations for parking lots, buildings, stadiums, fields, industrial regions, parks, beaches, or water ways, and others.

From the early days, human beings have used a variety of techniques for lighting. Early humans relied on fire to light caves during hours of darkness. Fire often consumed wood for fuel. Wood fuel was soon replaced by candles, which were derived from oils and fats. Candles were then replaced, at least in part by lamps. Certain lamps were fueled by oil or other sources of energy. Gas lamps were popular and still remain important for outdoor activities such as camping. In the late 1800, Thomas Edison, who is one of the greatest inventors of all time, conceived the incandescent lamp, which uses a tungsten filament within a bulb, coupled to a pair of electrodes. Many conventional buildings and homes still use the incandescent lamp, commonly called the Edison bulb. Although highly successful, the Edison bulb consumed much energy and was generally inefficient.

Fluorescent lighting replaced incandescent lamps for certain applications. Fluorescent lamps generally consist of a tube containing a gaseous material, which is coupled to a pair of electrodes. The electrodes are coupled to an electronic ballast, which helps ignite the discharge from the fluorescent lighting. Conventional building structures often use fluorescent lighting, rather than the incandescent counterpart. Fluorescent lighting is much more efficient than incandescent lighting, but often has a higher initial cost.

Conventional lighting and more particularly sodium lamps have been used for outdoor lighting applications. Such outdoor applications include parking lots, streets, stadiums, buildings, and others. Although highly successful, street lamps and in particular sodium lamps are often prone to breakage and damage from mechanical shock. Such mechanical shock may be derived from an automobile crashing into a lamp post or multiple types of vandalism. As an example, street gangs and the like may often damage street lamps using hard objects such as rocks or even bullets shot from a firearm. In certain high crime areas, street lamps are often broken and never replaced since it is difficult to maintain them in working order.

From the above, it is seen that improved techniques for lighting are highly desired.

BRIEF SUMMARY OF THE INVENTION

According to the present invention, techniques related generally to lighting are provided. More particularly, the present invention provides a method and device using a plasma lighting device having a small form factor and durability for indoor and more preferably street lamp applications in high crime rate regions or other regions that lead to breakage or damage of convention street lamps. Merely by way of example, the street lamp applications can include various configurations for parking lots, buildings, stadiums, fields, industrial regions, parks, beaches or water ways, and others.

In a specific embodiment, the present invention provides a shock resistant outdoor lamp comprising a lamp apparatus, which is capable of withstanding an impact of a bullet or other hard object. In a specific embodiment, the apparatus has a housing having an inner region and an outer region. An inner cavity is formed from the inner region. A reflector is provided within a portion of the inner region. An RF power source is disposed within the inner cavity. In a specific embodiment, the RF power source is coupled to an AC source. In a preferred embodiment, the lamp has a small form factor bulb assembly coupled to the RF power source. The bulb assembly includes a base member, which has an outer region capable of being coupled to first AC potential and an inner region capable of being coupled to a second AC potential. The bulb assembly also has a support body coupled to the base member and a shock resistant gas filled vessel having a transparent or translucent body having an inner surface and an outer surface and a sealed cavity formed within the inner surface. In a preferred embodiment, the gas filled vessel includes a first end region, a second end region, and the length defined between the first end region and the second end region. The small form factor is provided by an overall length ranging from about 3 millimeters to about 15 millimeters characterizing the gas filled vessel and a thickness of at least about 0.5 millimeters to about 2 millimeters characterizing a distance between the inner surface and the outer source of the transparent or translucent body in a specific embodiment. In a specific embodiment, the gas filled vessel can have a diameter ranging from about 1 millimeter to about 15 millimeters, but can be others. Of course, there can also be other dimensions depending upon the specific application. In a specific embodiment, at least one or more coupling members is operably coupled to the gas filled vessel such that the outer surface of the gas filled vessel is substantially free from mechanical damage caused with the one or more coupling members and substantially free from any openings in the thickness. In a preferred embodiment, the apparatus has a transparent cover comprising a polycarbonate material, which is capable of withstanding an impact of bullet from a conventional handgun or rifle, such as calibers ranging from about 22, 38, 45, 44 Magnum, 357 Magnum, and 7 mm, 9 mm, and others, including shot shells and/or pellets. A supporting member is coupled the housing. The supporting member has a vertical height of greater than fifteen feet, but can be others.

In an alternative specific embodiment, the present invention provides a shock resistant outdoor lamp comprising a lamp apparatus, which is capable of withstanding an impact of a bullet or other hard object. In a specific embodiment, the apparatus has a housing having an inner region and an outer region. An inner cavity is formed from the inner region. A reflector is provided within a portion of the inner region. An RF power source is disposed within the cavity. In a specific embodiment, the RF power source is coupled to an AC source. In a preferred embodiment, the lamp has a small form factor bulb assembly coupled to the RF power source. The bulb assembly includes a base member, which has an outer region capable of being coupled to first AC potential and an inner region capable of being coupled to a second AC potential. The bulb assembly also has a support body coupled to the base member and a shock resistant gas filled vessel having a transparent or translucent body having an inner surface and an outer surface and a cavity formed within the inner surface. In a preferred embodiment, the gas filled vessel includes a first end region, a second end region, and the length defined between the first end region and the second end region. In a specific embodiment, the small form factor is provided by an overall length ranging from about 3 millimeters to about 15 millimeters characterizing the gas filled vessel and a thickness of at least about 0.5 millimeters to about 2 millimeters characterizing a distance between the inner surface and the outer source of the transparent or translucent body. In a specific embodiment, the gas filled vessel can have a diameter ranging from about 1 millimeter to about 15 millimeters, but can be others. Of course, there can also be other dimensions depending upon the specific application. In a specific embodiment, at least one or more coupling members is operably coupled to the gas filled vessel such that the outer surface of the gas filled vessel is substantially free from mechanical damage caused with the one or more coupling members and substantially free from any openings in the thickness.

Benefits are achieved over pre-existing techniques using the present invention. In a specific embodiment, the present invention provides a method and apparatus using a small form factor electrodeless bulb for a street lamp application requiring shock or impact resistance. In a preferred embodiment, the present invention provides a method and configurations with an arrangement that provides for improved manufacturability as well as design flexibility. Other embodiments may include a substantially impact resistant cover, which would also help make the present apparatus shock proof or generally shatterproof upon impact with certain objects. In a preferred embodiment, the present apparatus can be used in a geographic area having high rates of vandalism without compromising the present apparatus. In a specific embodiment, the present apparatus and bullet proof fixture can also lead to lower crime rates. In a preferred embodiment, the bulb is substantially free from internal electrodes and/or external mechanical stress that leads to breakage and the like. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

DETAILED DESCRIPTION OF THE INVENTION

According to the present invention, techniques related generally to lighting are provided. More particularly, the present invention provides a method and device using a plasma lighting device having a small form factor and durability for indoor and more preferably street lamp applications in high crime rate regions or other regions that lead to breakage or damage of convention street lamps. Merely by way for parking lots, buildings, stadiums, fields, industrial regions, parks, beaches or water ways, and others.

Figure 1:
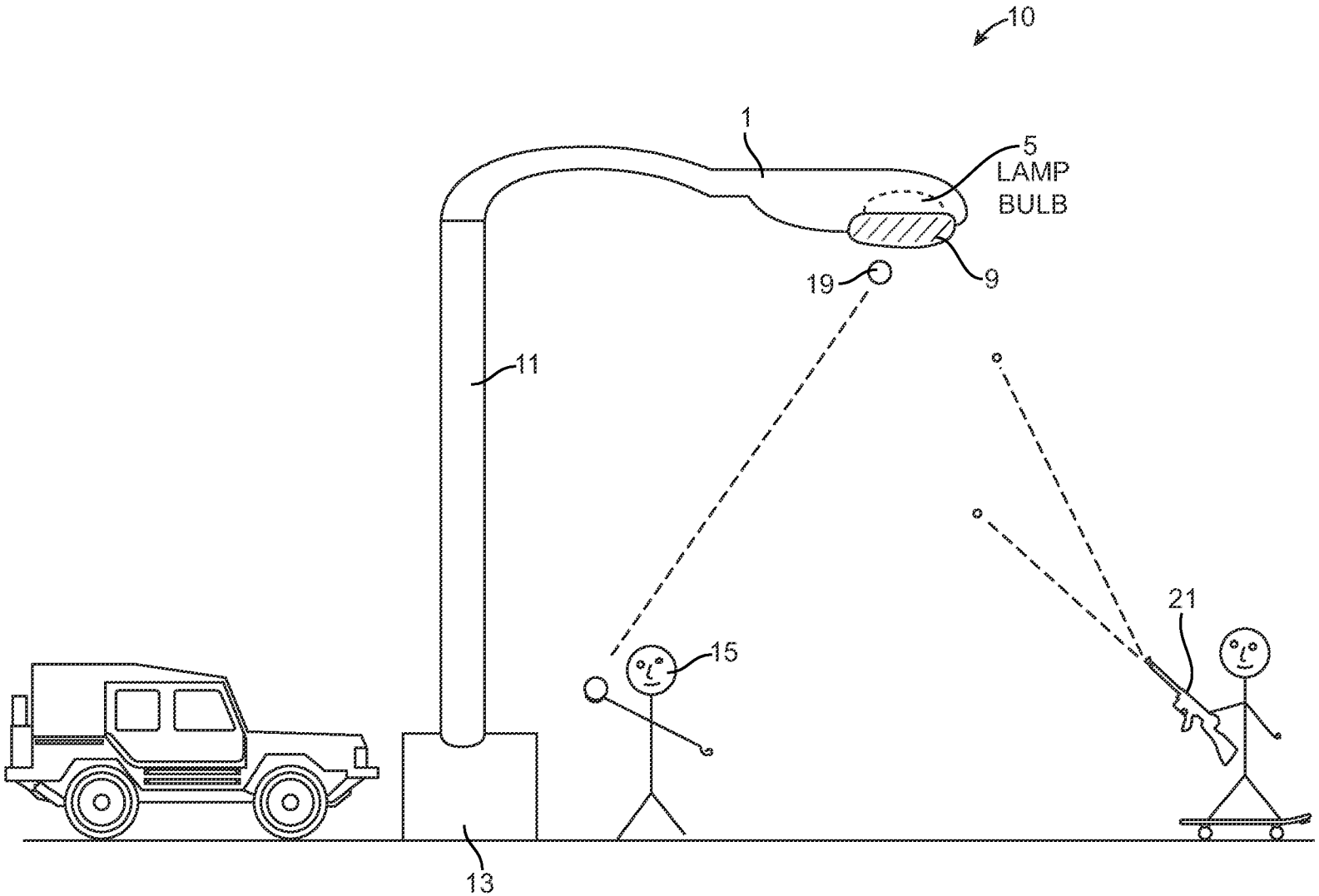
FIG. 1 is a simplified diagram of a conventional street lamp according to an embodiment of the present invention.

FIG. 1 is a simplified diagram of a conventional street lamp according to an embodiment of the present invention. As shown, the conventional street lamp 10 has a large head structure 1, which includes a large incandescent lamp 9. The large incandescent lamp is often sodium based or other conventional material. As shown, the large lamp occupies a large spatial region of the head structure and serves as an easy target for vandals. The large lamp often has a length of six inches and a width of about three inches, which, again, serves as a large target for a vandal. The large incandescent lamp is often fragile and prone to breakage upon impact. The head structure generally includes a plate 9 covering the lamp 10. The plate is also made of a fragile material such as glass or plastic material, which can fracture upon impact. The head is mounted to a pole 111 coupled to a base 13 that is secured to a ground or other building structure.

As shown, the lamp and plate are often prone to damage or breakage. That is, hard objects such as a rock 19 or ball impacts the plate, which can often break and/or cause damage to the lamp. As shown, vandals 15 often throw rocks or shoot out the plate and lamp. A firearm 21 is often a choice apparatus for shooting, although there can be others. In city areas with high crime rates, street lamps are often broken from vandalism causing even higher rates of crime and other socially undesirable activities. Additionally, in certain suburban or country areas, street lamps are also damaged from vandalism leading to more vandalism and other undesirable activities. These and other limitations with conventional street lamps have been overcome by way of the present street lamp and related methods, which have been described throughout the present specification and more particularly below.

Figure 2:
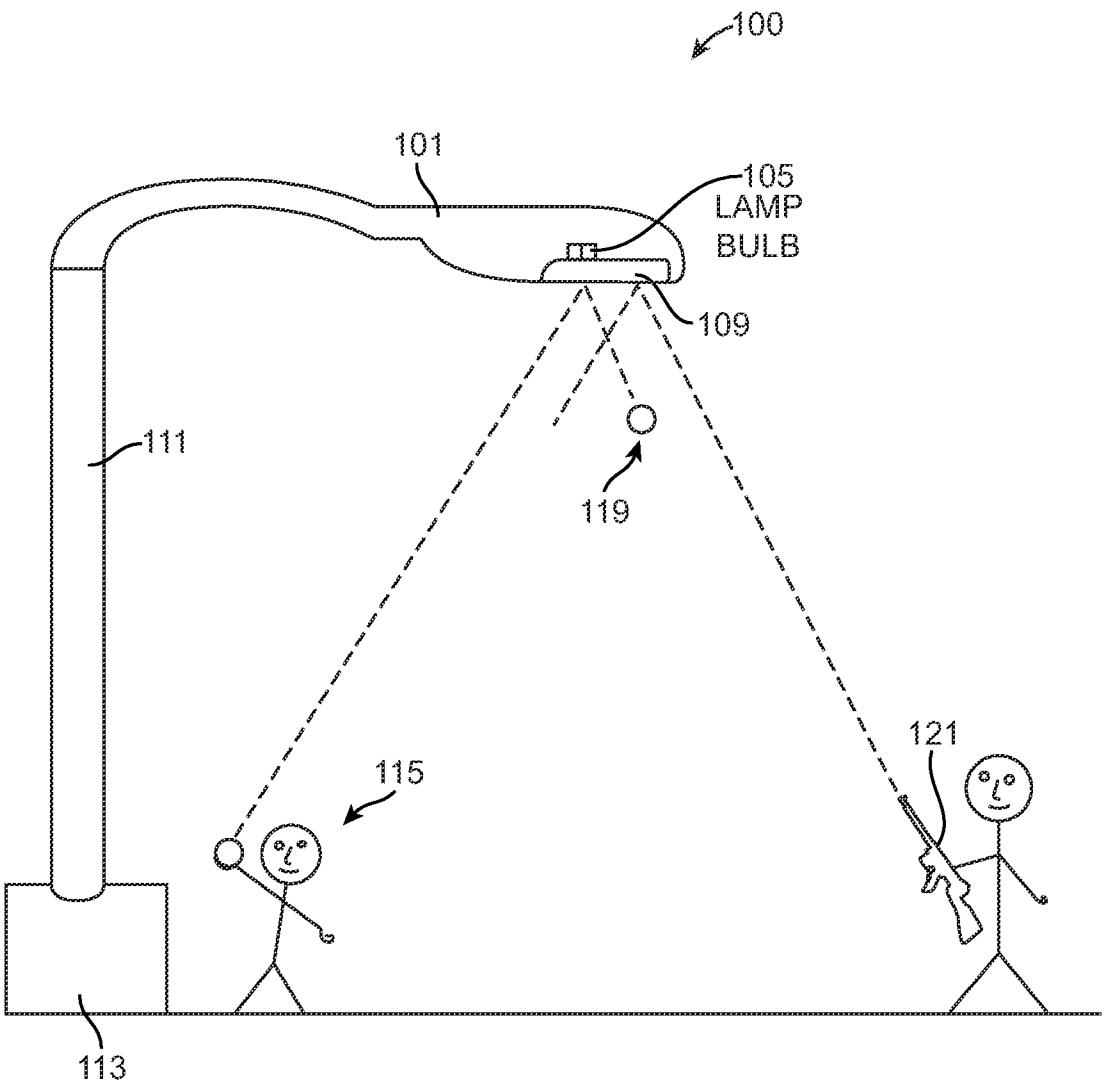
FIG. 2 is a simplified diagram of a street lamp according to an embodiment of the present invention.

FIG. 2 is a simplified diagram of a street lamp according to an embodiment of the present invention This diagram is merely an example, which should not unduly limit the scope of the claims herein. One of ordinary skill in the art would recognize other variations, modifications, and alternatives. As shown, the present street lamp 100 has a head structure 110, which includes a small form factor electrodeless lamp 109. In a specific embodiment, the small form factor lamp is often an electrodeless lamp such as those described in U.S. patent application Ser. No. 12/484,933, filed on Jun. 15, 2009, now U.S. Pat. No. 7,830,092, and PCT Application Serial No. PCT/US2009/048171, filed on Jun. 22, 2009, commonly assigned, and hereby incorporated by reference. Alternatively, such lamp can be described in U.S. Pat. No. 6,737,809, among others, which are incorporated by reference according to a specific embodiment. As shown, the lamp occupies a small spatial region of the head structure. The small form factor is provided by an overall length ranging from about 3 millimeters to about 15 millimeters characterizing the gas filled vessel and a thickness of at least about 0.5 millimeters to about 2 millimeters characterizing a distance between the inner surface and the outer source of the transparent or translucent body. In a specific embodiment, the gas filled vessel can have a diameter ranging from about 1 millimeter to about 15 millimeters, but can be others. Of course, there can also be other dimensions depending upon the specific application. In a preferred embodiment, the present lamp is much smaller than conventional sodium based lamp devices. Unlike the conventional lamps, the present small form factor lamp is generally not fragile and not prone to breakage upon impact. Further details of experimental data regarding impact are provided in more detail below.

In a specific embodiment, the head structure also includes a plate 119 covering the lamp 110. In a specific embodiment, the plate is suitable made of a durable material, such as polycarbonate or other like materials. In a specific embodiment, the plate is optically transparent, but has suitable strength upon impact. The plate can be a single layered structure, molded, extruded, or a single homogeneous material, including any combinations and the like. In a specific embodiment, the term "bullet proof" glass is often a type of polycarbonate material that is suitable for the present small form factor apparatus. Further details of the present lamp are provided below.

In a specific embodiment, the head is mounted to a pole 111 coupled to a base 13 that is secured to a ground or other building structure. In a specific embodiment, the pole can be made of a metal material, wood, or plastic, as well as others. In a specific embodiment, the pole has a length of at least about 15 feet or others. In other embodiments, the pole can be replaced by a building structure or a combination of a mounting member and the building structure. The building structure can be a house, commercial building, bill board, stadium, tree, pole, bridge, street, or others. Of course, there can be other variations, modifications, and alternatives.

As shown, the present lamp and plate are often not prone to damage or breakage. That is, hard objects such as a rock 119 or ball impacts the plate, which remains intact and does not break and/or cause damage to the lamp. As shown, vandals 115 would attempt to throw rocks or shoot out the plate and lamp, but will be generally unsuccessful. A firearm 121 is often a choice apparatus for shooting, although there can be others. In city areas with high crime rates, street lamps would not be broken from certain types vandalism and remain working and intact. Additionally, in certain suburban or country areas, street lamps would also not be damaged from certain types of vandalism leading to more vandalism and other undesirable activities. Further details of the present street lamp can be found throughout the present specification and more particularly below.

Figure 3:
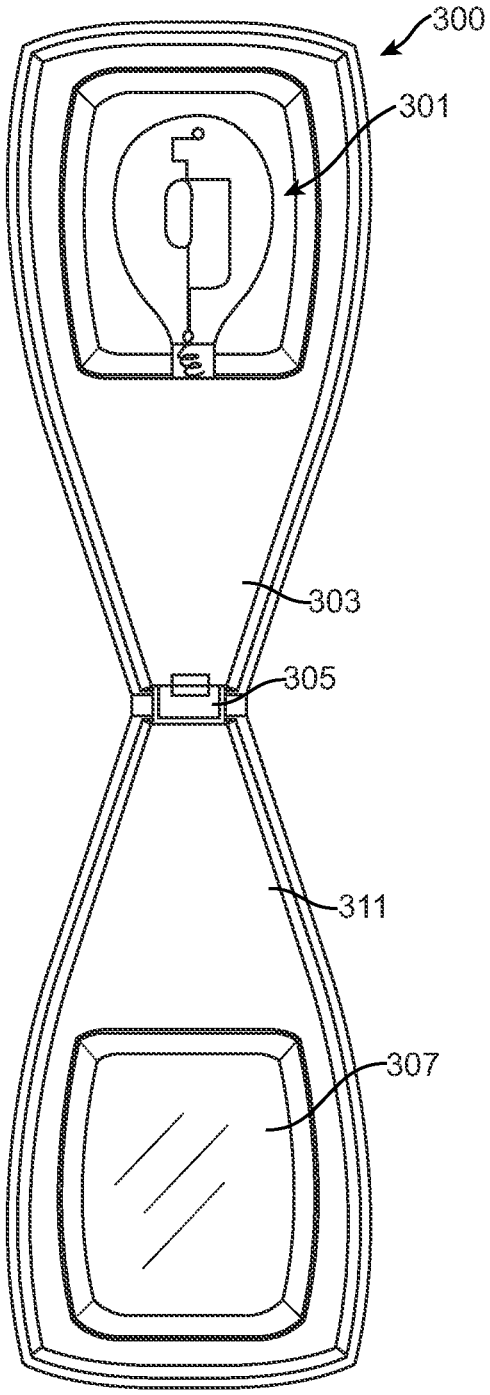
FIG. 3 is a simplified diagram of a conventional street lamp housing for a cobra head design.

FIG. 3 is a simplified diagram of a conventional housing 300 for a cobra head lamp design. The cobra head lamp design is often used in street lighting, and has been used for many years. The cobra head design is shaped like a "cobra head" and is configured with a hinge 305 operably coupling an upper housing 303 and a lower housing 311 in a clam shell configuration, as shown. The upper housing includes a reflector region having a large sodium vapor lamp 301, as an example. The large lamp occupies at least fifty to eighty percent of a total region of the lens coupled to the upper housing. The conventional lamp often has a length of about eight inches and a width of three inches, which are good targets for vandalism and the like. The lower housing often includes a glass 307 lens or like structure, which is fragile upon impact. These and other limitations are overcome, at least in part, by way of the present lamp structure and related methods, which are described in more detail below.

Figure 4:
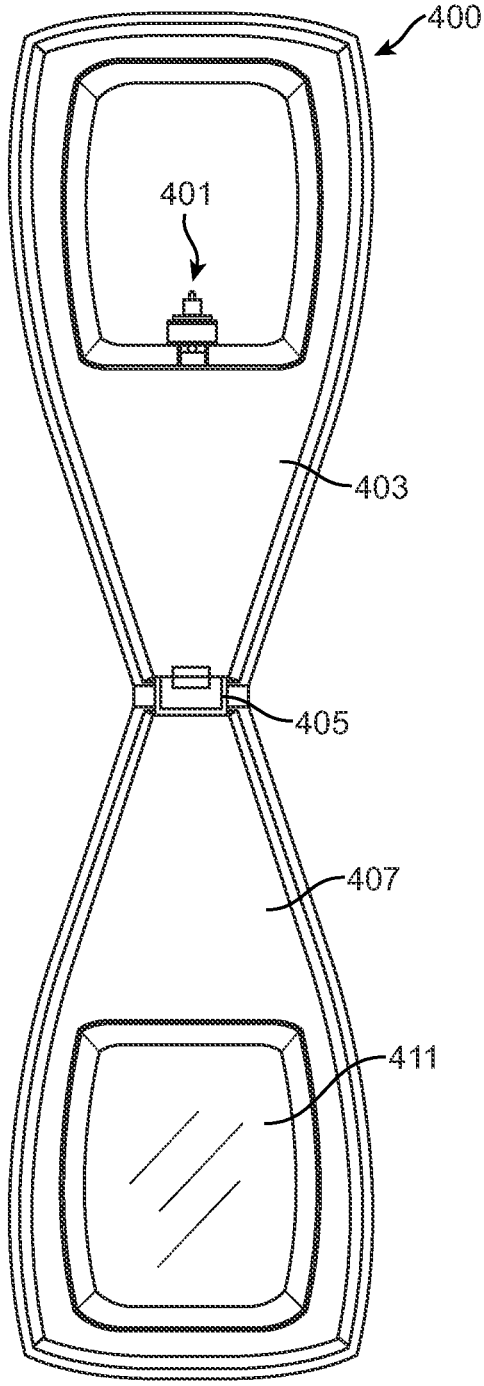
FIG. 4 is a simplified diagram of a street lamp housing for a cobra head design according to an embodiment of the present invention.
Figure 4A:
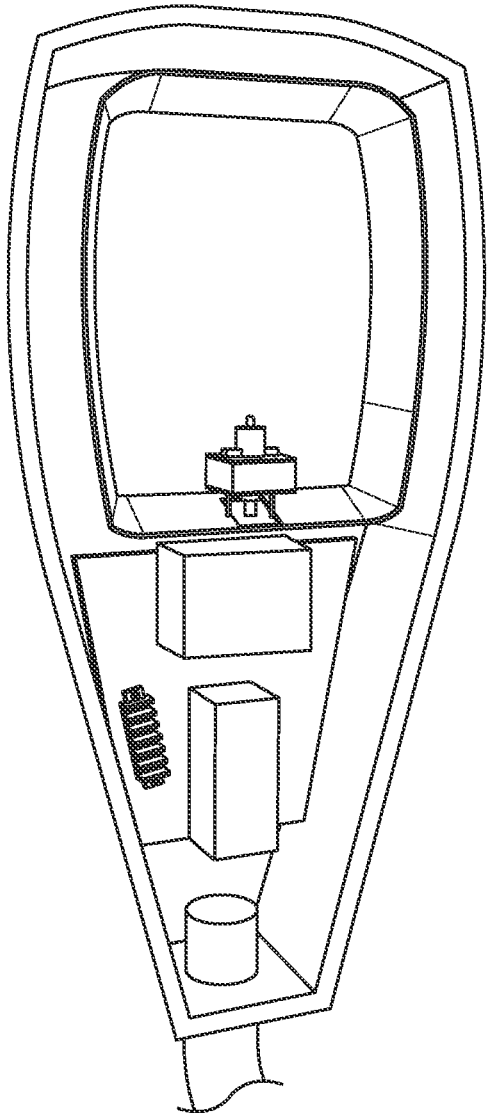
FIG. 4A is a simplified perspective diagram of the street lamp housing for the cobra head design according to an embodiment of the present invention.

FIG. 4 is a simplified diagram of a street lamp housing 400 for a cobra head design according to an embodiment of the present invention. This diagram is merely an example, which should not unduly limit the scope of the claims herein. One of ordinary skill in the art would recognize other variations, modifications, and alternatives. In a specific embodiment, the cobra head lamp design can be used with a small form factor lamp. In a specific embodiment, the cobra head design is shaped like a "cobra head" and is configured with a hinge 405 operably coupling an upper housing 403 and a lower housing 407 in a clam shell configuration, as shown. The upper housing includes a reflector region having a small form factor lamp assembly 401, as an example. The small lamp occupies at less than ten percent (or less than five percent) of a total region of the upper housing in a conventional cobra head lamp according to a preferred embodiment. The small form factor is provided by an overall length ranging from about 3 millimeters to about 15 millimeters characterizing the gas filled vessel and a thickness of at least about 0.5 millimeters to about 2 millimeters characterizing a distance between the inner surface and the outer source of the transparent or translucent body. In a specific embodiment, the gas filled vessel can have a diameter ranging from about 1 millimeter to about 15 millimeters, but can be others. Of course, there can also be other dimensions depending upon the specific application. The present lamp often has a length that is much smaller, which is a poor target for vandalism and the like. The lower housing often includes a bullet proof glass 411 lens or like structure, which is generally not fragile upon impact.

In a preferred embodiment, the small form factor lamp is an electrodeless lamp or the like. The small form factor lamp is often an electrodeless lamp such as those described in U.S. patent application Ser. No. 12/484,933, filed on Jun. 15, 2009, now U.S. Pat. No. 7,830,092, and PCT Application Serial No. PCT/US2009/048171, filed on Jun. 22, 2009, commonly assigned, and hereby incorporated by reference. Alternatively, such lamp can be described in U.S. Pat. No. 6,737,809, among others, which are incorporated by reference according to a specific embodiment. As shown, the lamp occupies a small spatial region of the head structure. In a specific embodiment, the present lamp often has a length of 10 millimeters and a width of 3 millimeter, which are much smaller than conventional sodium based lamp devices. In a preferred embodiment, the small form factor lamp is generally shock proof since it is free from internal electrodes, has a small form factor, and no external mechanical stress/stain. Unlike the conventional lamps, the present small form factor lamp is generally not fragile and not prone to breakage upon impact.

In a specific embodiment, the head structure also includes a bullet proof plate 411 covering the lamp 401. In a specific embodiment, the plate is suitable made of a durable material, such as polycarbonate or other like materials. In a specific embodiment, the plate is optically transparent, but has suitable strength upon impact. The plate can be a single layered structure, molded, extruded, or a single homogeneous material, including any combinations and the like. In a specific embodiment, the term "bullet proof" glass is often a type of polycarbonate material that is suitable for the present small form factor apparatus. In one or more embodiments, the bullet proof glass is often constructed using a strong but transparent material such as polycarbonate thermoplastic or by using layers of laminated glass. The desired result is a material with an appearance and light-transmitting behavior of standard glass but offers varying degrees of protection from small arms fire. See, for example, http://en.wikipedia.org/wiki/Bulletproof_glass#Recent_advances_in_bullet-resistant-_glass_composition. Of course, there can be other variations, modifications, and alternatives.

Figure 5:
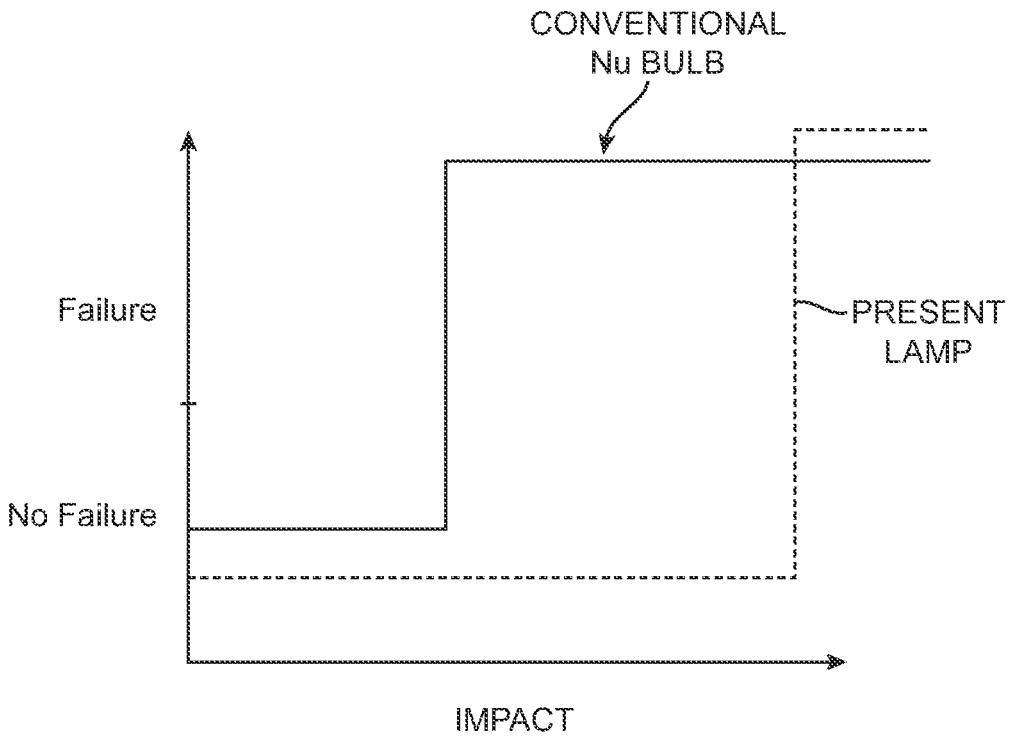
FIG. 5 is a simplified diagram of a relationship between impact and chronic failure for conventional and present lamp according to an embodiment of the present invention.

FIG. 5 is a simplified diagram of a relationship between impact and chronic failure for conventional and present lamp according to an embodiment of the present invention. This diagram is merely an example, which should not unduly limit the scope of the claims herein. One of ordinary skill in the art would recognize other variations, modifications, and alternatives. As shown, failure is provided on the vertical axis, while impact is on the horizontal axis. As can be seen, failure for the conventional lamp occurs at a selected region, which is often from impact of hard objects, bullets, or other things. Failure for the present lamp occurs at a much higher impact or may not occur at all. Indications for impacts from bullets fired from a 22 caliber rifle, 12 gauge shot gun, automobiles, and rocks are also illustrated. Of course, there can be other variations, modifications, and alternatives.

According to some embodiments of the present invention, techniques directed to devices and methods for generating light with plasma lamps are provided. More particularly, the present invention provides plasma lamps driven by a radio-frequency source without the use of electrodes and related methods. Merely by way of example, such plasma lamps can be applied to applications such as stadiums, security, parking lots, military and defense, streets, large and small buildings, bridges, warehouses, agriculture, uv water treatment, architectural lighting, stage lighting, medical illumination, microscopes, projectors and displays, any combination of these, and the like.

In a specific embodiment, the plasma electrodeless lamp comprises a dielectric body substantially covered with a conductive outer coating, closely receiving two coupling elements, the first coupling element connected to the output of an RF amplifier, and the second coupling element connected to the input of an RF amplifier. The first coupling element is conductively connected (grounded) to the conductive coating of the lamp body at its top surface, while the second coupling element is not. The lamp further comprises a bulb/coupling element assembly, the assembly being grounded to the conductive coating of the lamp body at is bottom surface. Electromagnetic energy is RF-coupled between the first coupling element and the bulb-coupling element assembly, and between the bulb-coupling element assembly and the second coupling element. Electromagnetic energy is capacitively, or inductively or a combination of inductively and capacitively coupled to the bulb within the bulb-coupling element assembly. The lamp may further comprise a reflector to direct the luminous output of the bulb in the bulb-coupling element assembly. Alternatively, it may not. The lamp further comprises a ground strap to conductively connect the top of the bulb-coupling element assembly to the conductive outer coating of the lamp body. Alternatively, the ground strap may conductively connect the top of the bulb-coupling element assembly to the reflector, which in turn is conductively connected to the lamp body.

In another embodiment, the second coupling element is removed, and the first coupling element is connected to the output of an RF source, which may further comprise an RF oscillator and amplifier.

In yet another embodiment, the lamp body comprises a metallic conductive body that is partially filled with a dielectric insert.

In yet another embodiment, the lamp body comprises a metallic conductive body that is substantially hollow, with no dielectric insert.

In yet another embodiment, the bulb-coupling element assembly within the plasma electrodeless lamp comprises a single or multi-sectioned body. In a first section, a first coupling element comprising a solid conductor is closely received but not wholly enclosed by a dielectric body. A portion of the first section may be conductively coated. In a second section, a gas-fill vessel (bulb) is closely received by a dielectric body; the gas-fill vessel may or may not be wholly enclosed by the dielectric body. In a third section, a second coupling element comprising a solid conductor is closely received but not wholly enclosed by a dielectric body. A portion of the third section may be conductively coated. No DC conduction path exists between the first and third sections; electromagnetic energy is capacitively or inductively or a combination of capacitively and inductively coupled between them through the second section.

In yet another aspect, the first and second coupling elements comprise dielectric material coated with a conductive veneer, and the gas-fill vessel is partially but closely received by the center dielectric portion of the first and second electrodes. No DC conduction path exists between the first and second electrodes; electromagnetic energy is capacitively or inductively or a combination of capacitively and inductively coupled between them through gas-fill vessel.

In a specific embodiment, the present invention provides an electrodeless plasma lamp. The lamp has a conductive housing having a spatial volume defined within the conductive housing. In a specific embodiment, the spatial volume having an inner region and an outer region within the conductive housing. The lamp has a support body having an outer surface region disposed within or partially within the inner region of the spatial volume of the conductive housing and a conductive material overlying the outer surface region of the support body. The lamp has a gas filled vessel having a transparent or translucent body having an inner surface and an outer surface and a cavity formed within the inner surface. In a specific embodiment, the lamp can also include both a transparent and translucent portion. The gas filled vessel comprises a first end region and a second end region and a length defined between the first end region and the second end region. A first element is coupled to the first end region of the gas filled vessel. The first coupling element is electrically coupled to the conductive material. A second coupling element is coupled to the second end region of the gas filled vessel. An RF source coupling element is spatially disposed within the outer region of the conductive housing and within a predetermined distance from the first coupling element. The lamp has a gap (e.g., air gap) provided between the source coupling element and the first coupling element. The gap provided by the predetermined distance according to a specific embodiment. The lamp has an RF source comprising an output and optionally an input. The output of the RF source is coupled to the first coupling element through the gap and the RF source coupling element.

In an alternative specific embodiment, the present invention provides an alternative electrodeless plasma lamp. The lamp has a conductive housing having a spatial volume defined within the conductive housing. The spatial volume has an inner region and an outer region within the conductive housing. In a specific embodiment, the lamp has a support body having an outer surface region disposed within or partially within the inner region of the spatial volume of the conductive housing and a conductive material overlying the outer surface region of the support body. The lamp has a gas filled vessel having a transparent or translucent body having an inner surface and an outer surface and a cavity formed within the inner surface. The gas filled vessel comprises a first end region and a second end region and a length defined between the first end region and the second end region. In a specific embodiment, the lamp has a first element coupled to the first end region of the gas filled vessel. The first element is electrically coupled to the conductive material. The lamp has an RF source coupling element spatially disposed within the outer region of the conductive housing and within a predetermined distance from the first coupling element. In a specific embodiment, the lamp has a gap provided between the RF source coupling element and the first coupling element. The gap is formed by the predetermined distance. In a specific embodiment, the lamp has an RF source comprising an output and optionally an input. The output of the RF source is coupled to the first coupling element through the gap and the RF source coupling element.

In yet an alternative specific embodiment, the present invention provides an electrodeless plasma lamp. The lamp has a conductive housing having a spatial volume defined within the conductive housing. The spatial volume having an inner region and an outer region. The lamp has a metal support body having an outer surface region disposed within or partially within the inner region of the spatial volume of the conductive housing. The lamp has a gas filled vessel having a transparent or translucent body having an inner surface and an outer surface and a cavity formed within the inner surface. The gas filled vessel comprises a first end region and a second end region and a length defined between the first end region and the second end region. The lamp has a first element coupled to the first end region of the gas filled vessel. In a specific embodiment, the first coupling element is electrically coupled to the conductive material. The lamp also has a second element coupled to the second end region of the gas filled vessel. An RF source coupling element is spatially disposed within the outer region of the conductive housing and within a predetermined distance from the first coupling element. A gap is provided between the source coupling element and the first coupling element. The lamp has an RF source comprising an output, which is coupled to the first coupling element through the gap and the source coupling element.

Still further, the present invention provides a method of operating an electrodeless plasma lamp device. The method includes providing a plasma lamp, which can be any of the ones described herein. The method includes transferring RF energy from the RF source to the input coupling element, which is coupled to a gas filled vessel through a first coupling element and an air gap. In a preferred embodiment, the RF energy has a frequency ranging from about 100 MHz to about 20 GHz, but can be others. The method includes illuminating electromagnetic energy substantially from the length of the gas filled vessel from discharge of the gas filled vessel. Optionally, the method includes transferring thermal energy from the gas filled vessel through a conductive material of the first coupling element. In a preferred embodiment, the conductive material can be characterized as a thermal conductor and an electrical conductor.

Moreover, the present invention provides a method of operating an electrodeless plasma lamp device. The method includes providing a plasma lamp device, which can be any of the ones described herein. The method includes adjusting a predetermined distance between an RF source coupling element and a first coupling element coupled to a gas filled vessel from a first distance to a second distance to change the first gap to a second gap, which is different from the first gap. In a preferred embodiment, the predetermined distance is an air gap or other non-solid region. Of course, there can be other variations, modifications, and alternatives.

Benefits are achieved over pre-existing techniques using the present invention. In a specific embodiment, the present invention provides a method and device having configurations of input, output, and feedback coupling elements that provide for electromagnetic coupling to the bulb whose power transfer and frequency resonance characteristics that are largely independent of the conventional dielectric resonator. In a preferred embodiment, the present invention provides a method and configurations with an arrangement that provides for improved manufacturability as well as design flexibility. Other embodiments may include integrated assemblies of the output coupling element and bulb that function in a complementary manner with the present coupling element configurations and related methods. Still further, the present method and device provide for improved heat transfer characteristics, as well as further simplifying manufacturing. In a specific embodiment, the present method and resulting structure are relatively simple and cost effective to manufacture for commercial applications. Depending upon the embodiment, one or more of these benefits may be achieved.

Figure 6A:
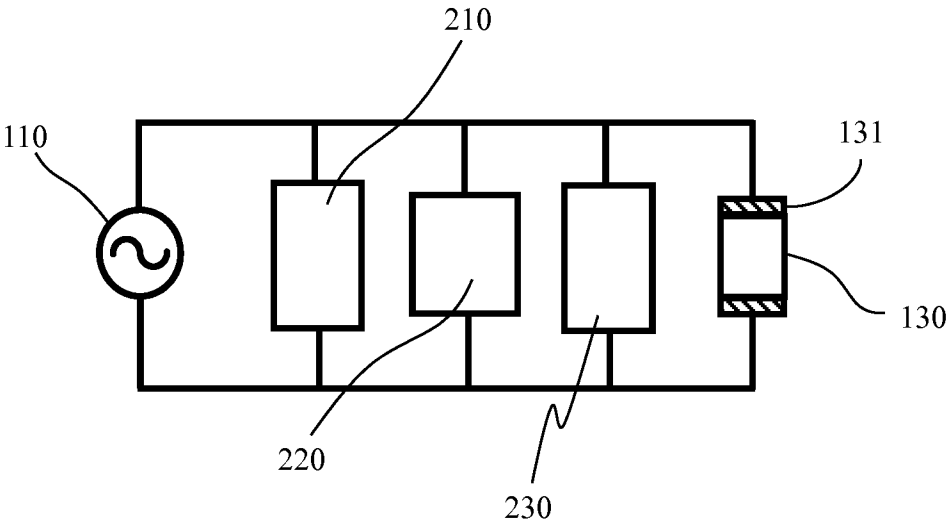
FIGS. 6A-10D show detailed illustrations of the coupling members.

FIG. 6A illustrates a general schematic for efficient energy transfer from RF source 110 to gas fill vessel 130. This diagram is merely an example, which should not unduly limit the scope of the claims herein. One of ordinary skill in the art would recognize other variations, modifications, and alternatives. Energy from the RF source is directed to an impedance matching network 210 that enables the effective transfer of energy from RF source to resonating structure 220. An example of such impedance matching network is an E-field or H-field coupling element, but can be others. Another impedance matching network 230, in turn, enables efficient energy transfer from resonator to gas fill vessel 130 according to an embodiment of the present invention. An example of the impedance matching network is an E-field or H-field coupling element. Of course, there can be other variations, modifications, and alternatives.

In a specific embodiment, the gas filled vessel is made of a suitable material such as quartz or other transparent or translucent material. The gas filled vessel is filled with an inert gas such as Argon and a fluorophor such as Mercury, Sodium, Dysprosium, Sulfur or a metal halide salt such as Indium Bromide, Scandium Bromide, or Cesium Iodide (or it can simultaneously contain multiple fluorophors). Mercury, Thalium Iodide, and Indium Bromide according to a specific embodiment. The gas filled vessel can also includes a metal halide, or other metal pieces that will discharge electromagnetic radiation according to a specific embodiment. Of course, there can be other variations, modifications, and alternatives.

In a specific embodiment, a capacitive coupling structure 131 is used to deliver RF energy to the gas fill within the bulb 130. As is well known, a capacitive coupler typically comprises two electrodes of finite extent enclosing a volume and couples energy primarily using at least Electric fields (E-fields). As can be appreciated by one of ordinary skill in the art, the impedance matching networks 210 and 230 and the resonating structure 220, as depicted in schematic form here, can be interpreted as equivalent-circuit models of the distributed electromagnetic coupling between the RF source and the capacitive coupling structure. The use of impedance matching networks also allows the source to have an impedance other than 50 ohm; this may provide an advantage with respect to RF source performance in the form of reduced heating or power consumption from the RF source. Lowering power consumption and losses from the RF source would enable a greater efficiency for the lamp as a whole. As can also be appreciated by one of ordinary skill in the art, the impedance matching networks 210 and 230 are not necessarily identical.

Figure 6B:
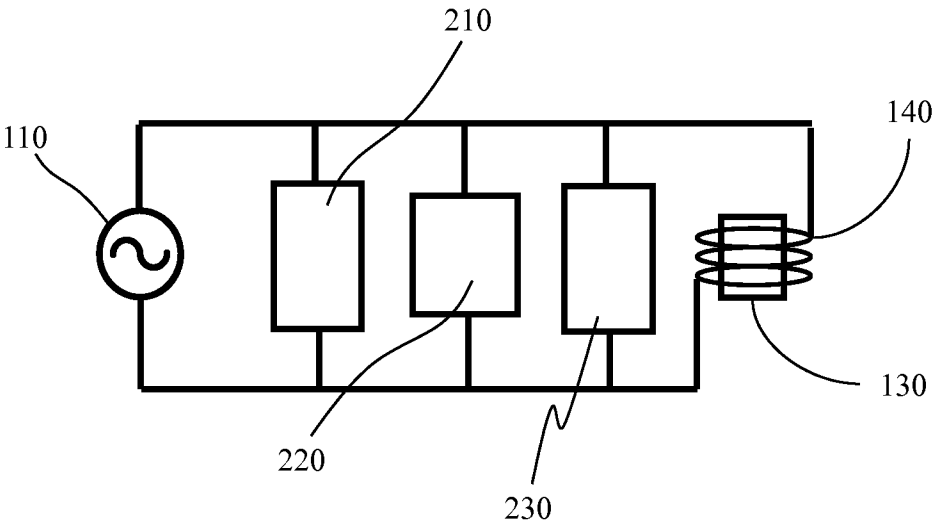

FIG. 6B illustrates a general schematic for efficient energy transfer from RF source 110 to gas fill vessel 130. This diagram is merely an example, which should not unduly limit the scope of the claims herein. One of ordinary skill in the art would recognize other variations, modifications, and alternatives. Energy from the RF source is directed to an impedance matching network 210 that enables the effective transfer of energy from RF source to resonating structure 220. Another impedance matching network 230, in turn, enables efficient energy transfer from resonator to gas fill vessel 130. An inductive coupling structure 140 is used to deliver RF energy to the gas fill within the bulb 130. As is well known, an inductive coupler typically comprises a wire or a coil-like wire of finite extent and couples energy primarily using magnetic fields (H-fields). As can be appreciated by one of ordinary skill in the art, the impedance matching networks 210 and 230 and the resonating structure 220, as depicted in schematic form here, can be interpreted as equivalent-circuit models of the distributed electromagnetic coupling between the RF source and the inductive coupling structure. The use of impedance matching networks also allows the source to have an impedance other than 50 ohm; this may provide an advantage with respect to RF source performance in the form of reduced heating or power consumption from the RF source. Lowering power consumption and losses from the RF source would enable a greater efficiency for the lamp as a whole. As can also be appreciated by one of ordinary skill in the art, the impedance matching networks 210 and 230 are not necessarily identical.

Figure 7A:
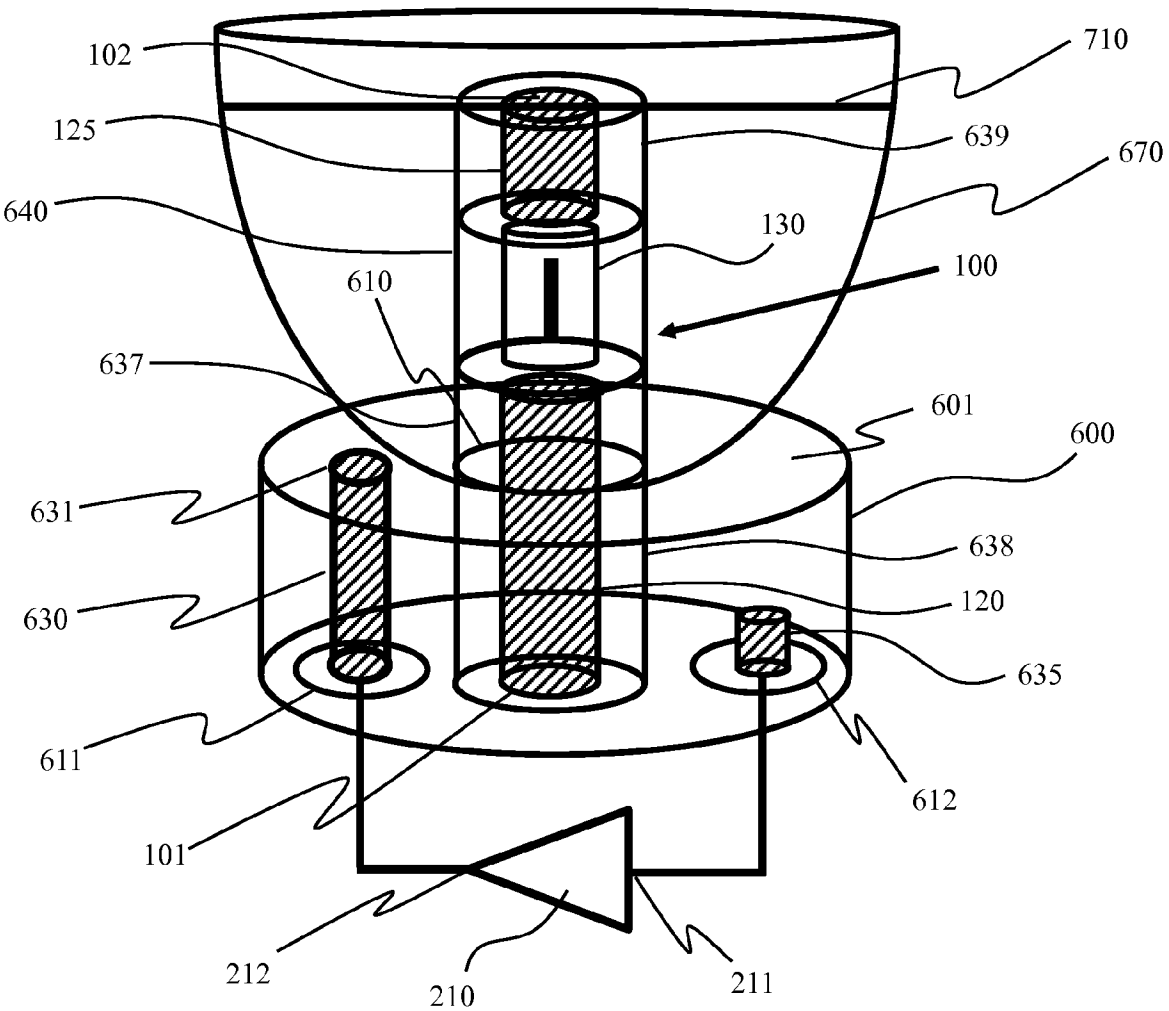

FIG. 7A is a perspective view of an electrodeless lamp, employing a lamp body 600, whose outer surface 601 is electrically conductive and is connected to ground. This diagram is merely an example, which should not unduly limit the scope of the claims herein. One of ordinary skill in the art would recognize other variations, modifications, and alternatives. A cylindrical lamp body is depicted, but rectangular or other shapes may be used. This conductivity may be achieved through the application of a conductive veneer, or through the choice of a conductive material. An example embodiment of conductive veneer is silver paint or alternatively the lamp body can be made from sheet of electrically conductive material such as aluminum. An integrated bulb/output coupling-element assembly 100 is closely received by the lamp body 600 through opening 610. The bulb/output coupling-element assembly 100 contains the bulb 130, which is a gas-fill vessel that ultimately produces the luminous output.

One aspect of the invention is that the bottom of the assembly 100, output coupling-element 120, is grounded to the body 600 and its conductive surface 601 at plane 101. The luminous output from the bulb is collected and directed by an external reflector 670, which is either electrically conductive or if it is made from a dielectric material has an electrically conductive backing, and which is attached to and in electrical contact with the body 600. Another aspect of the invention is that the top of the assembly 100, top coupling-element 125, is grounded to the body 600 at plane 102 via the ground strap 710 and the reflector 670. Alternatively, the reflector 670 may not exist, and the ground strap makes direct electrical contact with the body 600. Reflector 670 is depicted as parabolic in shape with bulb 130 positioned near its focus. Those of ordinary skill in the art will recognize that a wide variety of possible reflector shapes can be designed to satisfy beam-direction requirements. In a specific embodiment, the shapes can be conical, convex, concave, trapezoidal, pyramidal, or any combination of these, and the like. The shorter feedback E-field coupling-element 635 couples a small amount of RF energy from the bulb/output coupling-element assembly 100 and provides feedback to the RF amplifier input 211 of RF amplifier 210. Feedback coupling-element 635 is closely received by the lamp body 600 through opening 612, and as such is not in direct DC electrical contact with the conductive surface 601 of the lamp body. The input coupling-element 630 is conductively connected with RF amplifier output 212. Input coupling-element 630 is closely received by the lamp body 600 through opening 611, and as such is not in direct DC electrical contact with the conductive surface 601 of the lamp body. However, it is another key aspect of the invention that the top of the input coupling-element is grounded to the body 600 and its conductive surface 601 at plane 631.

RF power is primarily inductively coupled strongly from the input coupling-element 630 to the bulb/output coupling-element assembly 100 through physical proximity, their relative lengths, and the relative arrangement of their ground planes. Surface 637 of bulb/output coupling-element assembly is covered with an electrically conductive veneer or an electrically conductive material and is connected to the body 600 and its conductive surface 601. The other surfaces of the bulb/output coupling-element assembly including surfaces 638, 639, and 640 are not covered with a conductive layer. In addition, surface 640 is optically transparent or translucent. The coupling between input coupling-element 630 and output coupling-element 120 and lamp assembly 100 is found through electromagnetic simulation, and through direct measurement, to be highly frequency selective and to be primarily inductive. This frequency selectivity provides for a resonant oscillator in the circuit comprising the input coupling-element 630, the bulb/output coupling-element assembly 100, the feedback coupling-element 635, and the amplifier 210.

One of ordinary skill in the art will recognize that the resonant oscillator is the equivalent of the RF source 110 depicted schematically in FIG. 6A and FIG. 6B. A significant advantage of the invention is that the resonant frequency is strongly dependent on the relative lengths of the input and output coupling-elements, and is moreover very weakly dependent on the dimensions or dielectric properties of the lamp body 600 itself. This permits the use of a compact lamp body whose natural resonant frequency may be much higher than the actual frequency of operation. In one example embodiment, the bottom of the lamp body 600 may consist of a hollow aluminum cylinder with a 1.5" diameter, and a height of 0.75". The fundamental resonant frequency of such an air cavity resonator is approximately 4 GHz but by using the design described above for the input coupling-element and the output coupling-element and by adjusting the length of the output coupling-element the overall resonant frequency of the lamp assembly can be reduced to 900 MHz or no greater than about 900 MHz in a specific embodiment. Another significant advantage of the invention is that the RF power coupled to the bulb 130 is strongly dependent on the physical separation between the input coupling-element 630 and the output coupling-element 120 within the bulb/output coupling-element assembly 100. This permits fine tuning, at assembly time, of the brightness output of a lamp which is comprised of components with relaxed dimensional tolerances. Another significant advantage of the invention is that the input coupling-element 630 and the bulb/output coupling-element assembly 100 are respectively grounded at planes 631 and 101, which are coincident with the outer surface of the body 600. This eliminates the need to fine-tune their depth of insertion into the lamp body—as well as any sensitivity of the RF coupling between them to that depth—simplifying lamp manufacture, as well as improving consistency in lamp brightness yield.

Figure 7B:
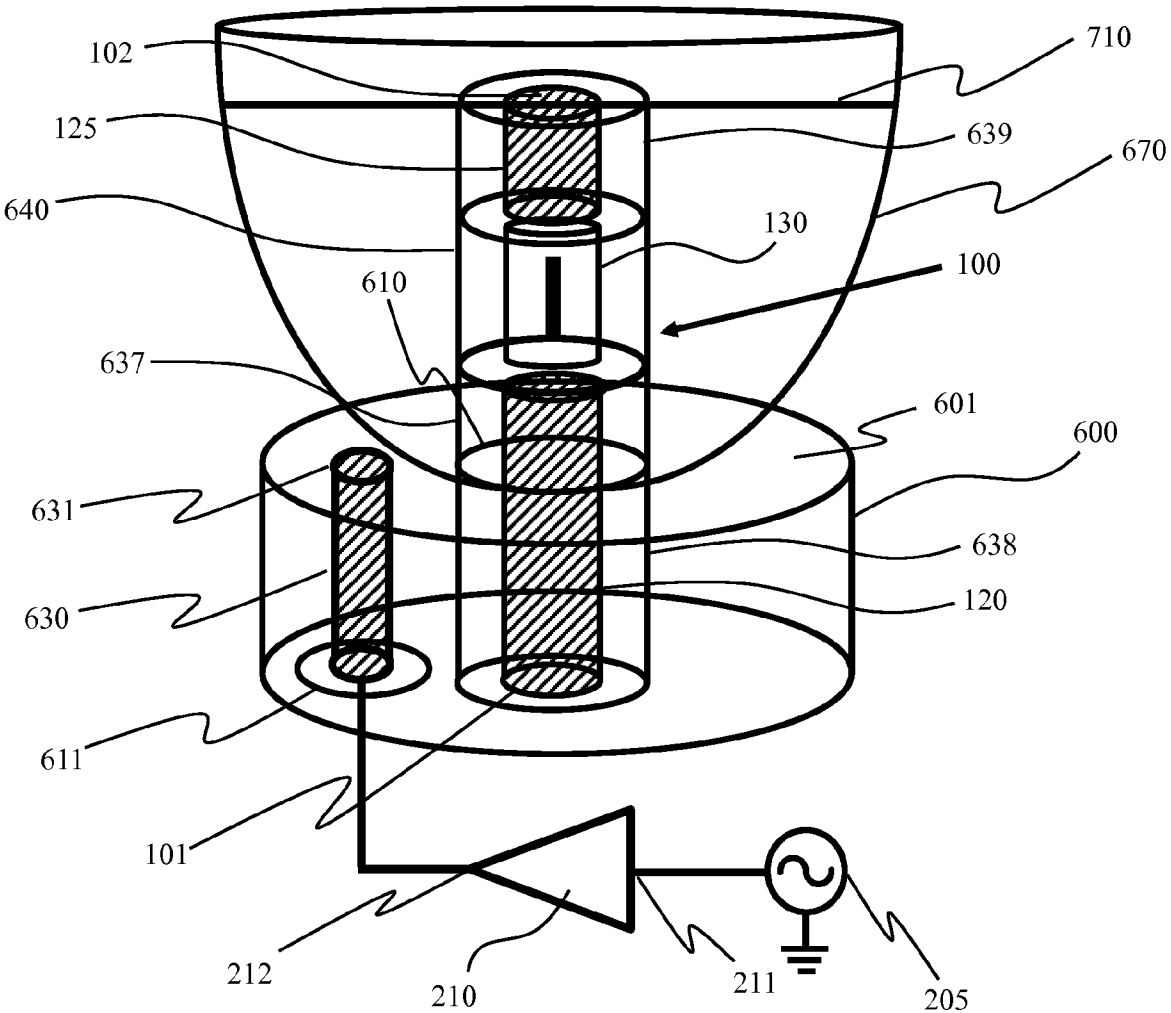

FIG. 7B is a perspective view of an electrodeless lamp that differs from that shown in FIG. 7A only in its RF source, which is not a distributed oscillator circuit, but rather a separate oscillator 205 conductively connected with RF amplifier input 211 of the RF amplifier 210. RF amplifier output 212 is conductively connected with input coupling-element 630, which delivers RF power to the lamp/output coupling-element assembly 100. The resonant characteristics of the coupling between the input coupling-element 630 and the output coupling-element in the bulb/output coupling-element assembly 100 are frequency-matched to the RF source to optimize RF power transfer. Of course, there can be other variations, modifications, and alternatives.

Figure 7C:
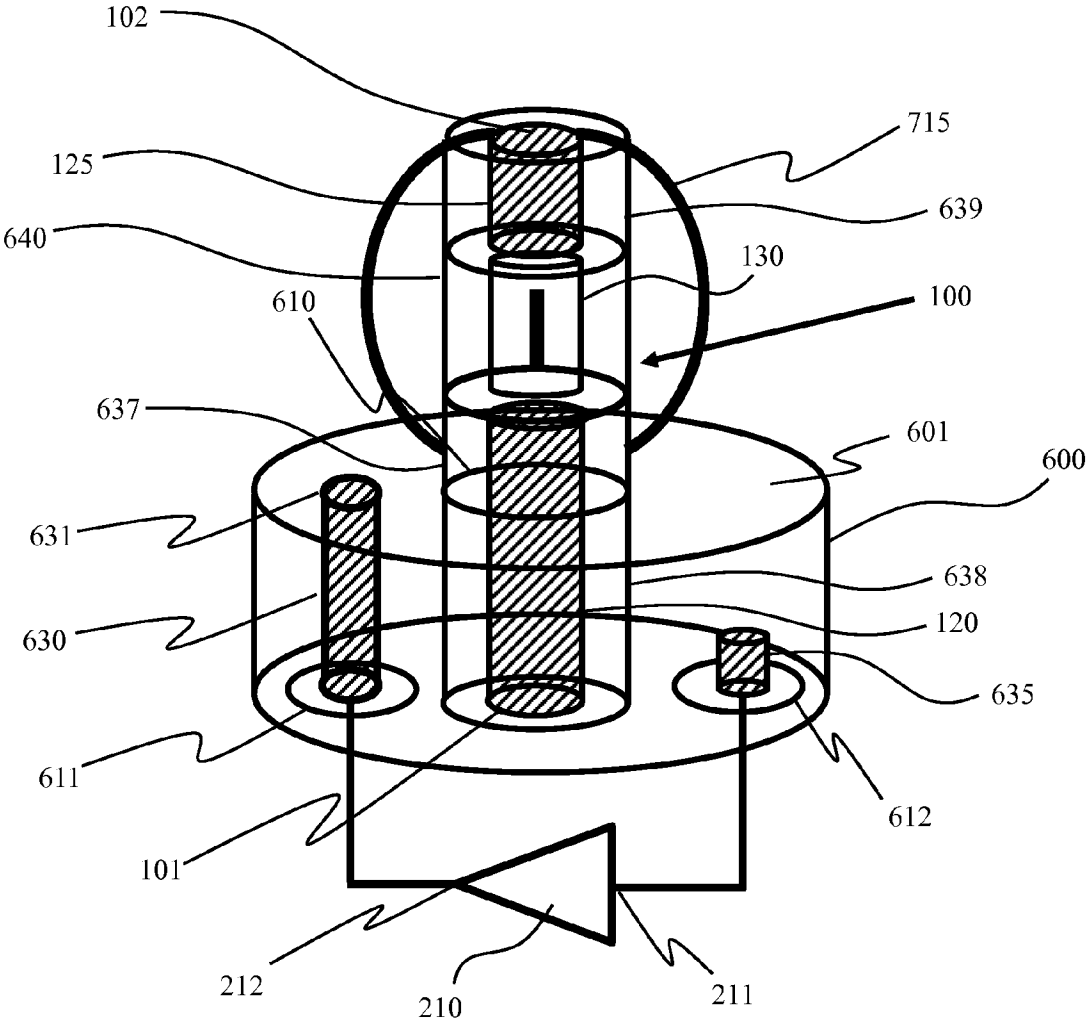

FIG. 7C is a perspective view of an electrodeless lamp that is similar to the electrodeless lamp shown in FIG. 2A except that it does not have a reflector 670. The top coupling-element 125 in the bulb assembly is directly connected to the lamp body 600 using ground straps 715. This diagram is merely an example, which should not unduly limit the scope of the claims herein. One of ordinary skill in the art would recognize other variations, modifications, and alternatives FIG. 8A is a perspective view of an integrated bulb/output coupling-element assembly 100 which is the same as assembly 100 depicted in FIGS. 2A, 2B, and 2C. This diagram is merely an example, which should not unduly limit the scope of the claims herein. One of ordinary skill in the art would recognize other variations, modifications, and alternatives. The assembly comprises a lower section 110, a mid-section 111, and upper section 112. Alternatively, these sections may not be physically separate. The lower section 110 is bored to closely receive output coupling-element 120, which is a solid conductor. Coupling-element 120 protrudes from the lower section 110 at plane 121. It is a key aspect of this invention that coupling-element 120 makes ground contact at plane 121 with the lamp body 600 depicted in FIGS. 7A, 7B, and 7C. The mid-section 111 is hollowed to closely receive the bulb 130, which is the gas-fill vessel that ultimately produces the lamp's luminous output. The gas-fill vessel contains an inert gas such as Argon and a fluorophor such as Mercury, Sodium, Sulfur or a metal halide salt such as Indium Bromide or Cesium Iodide (or it can simultaneously contain multiple fluorophors). Alternatively, the mid-section 111 is hollowed, with the resulting cavity forming the volume of the bulb 130, making the two an integrated unit. The mid-section 111 can be attached to the lower section 110 and upper section 112 using high temperature adhesive. The upper section 112 is bored to closely receive top electrode 125, which is a solid conductor. Top electrode 125 protrudes from upper section 112 at plane 126. It is a key aspect of this invention that the top coupling-element 125 makes ground contact at plane 126 with the lamp body 600, as depicted in FIGS. 7A, 7B, and 7C. This is through the ground strap 710 and the reflector body 670 or ground strap 715. Overall, RF energy is coupled capacitively, or inductively, or a combination of inductively and capacitively, by the output coupling-element 120 and top coupling-element 125 to the bulb 130 which is made from quartz, translucent alumina, or other similar material, ionizing the inert gas and vaporizing the fluorophor resulting in intense light 115 emitted from the lamp.

Figure 9:
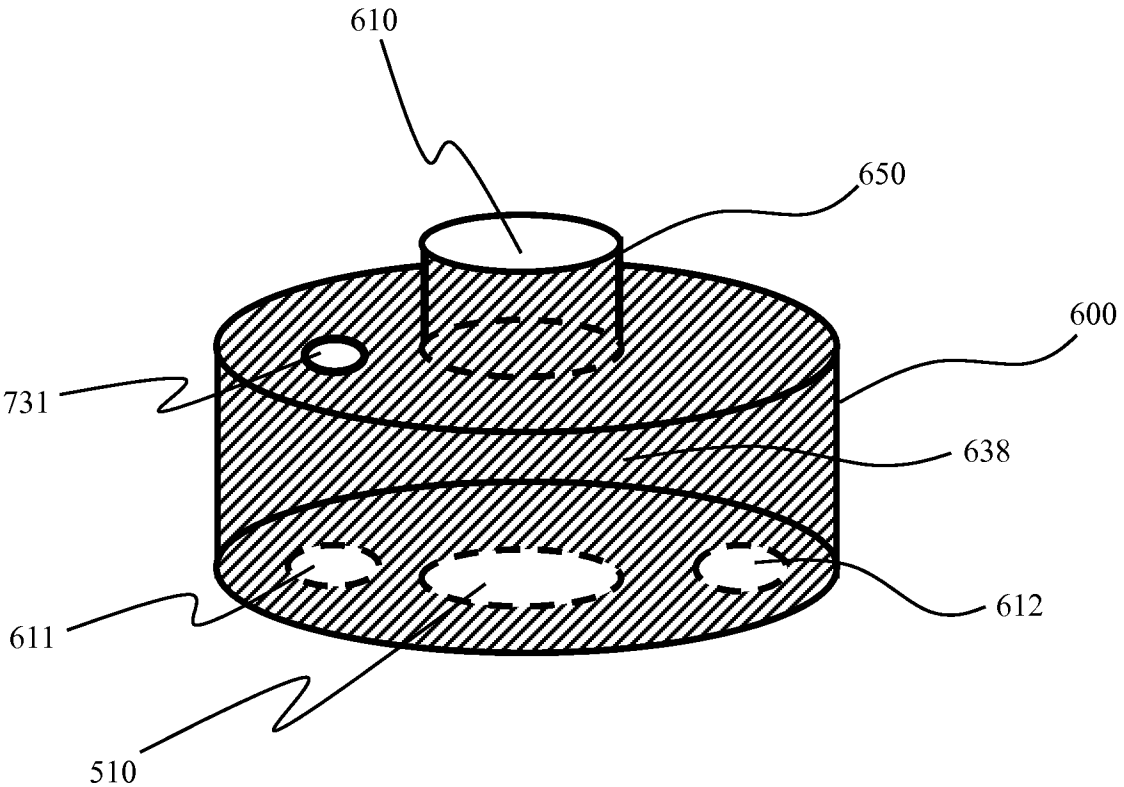

Sections 110, 111, and 112 can all be made from the same material or from different materials. Section 111 has to be transparent to visible light and have a high melting point such as quartz or translucent alumina. Sections 110 and 112 can be made from transparent (quartz or translucent alumina) or opaque materials (alumina) but they have to have low loss at RF frequencies. In the case that the same material is used for all three sections the assembly can be made from a single piece of material such as a hollow tube of quartz or translucent alumina. The upper section 112 may be coated with a conductive veneer 116 whose purpose is to shield electromagnetic radiation from the top-electrode 125. The lower section 110 may be partially coated with a conductive veneer 117 whose purpose is to shield electromagnetic radiation from the output coupling-element 120. The partial coating would extend to the portion of the lower section 110 that protrudes from the lamp body 600, as depicted in FIGS. 7A, 7B, and 7C and does not overlap with input coupling-element 630. The plane dividing that portion that protrudes from the lamp body from that portion that does not being depicted schematically by dashed line 140. An example embodiment of conductive veneers 116 and 117 is silver paint. Alternatively, instead of conductive veneers portion of the lower section 110 can be covered by a metal ring 650 as part of the extension of lamp body 600 as depicted in FIG. 9. The outer surface of the mid section 111 is not coated.

Figure 8B:
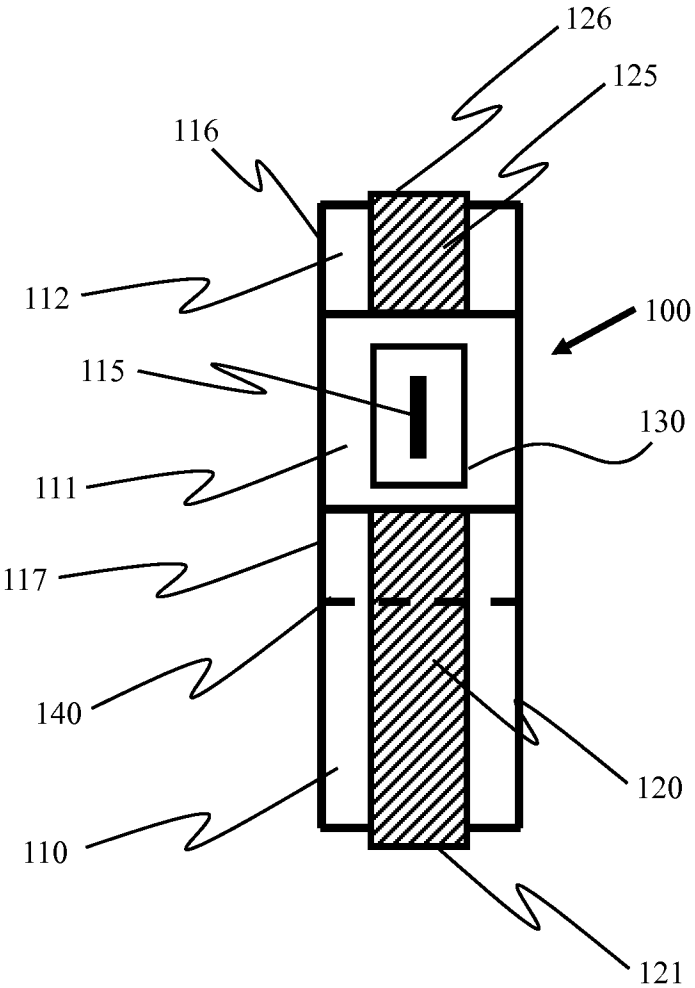
Figure 8A:
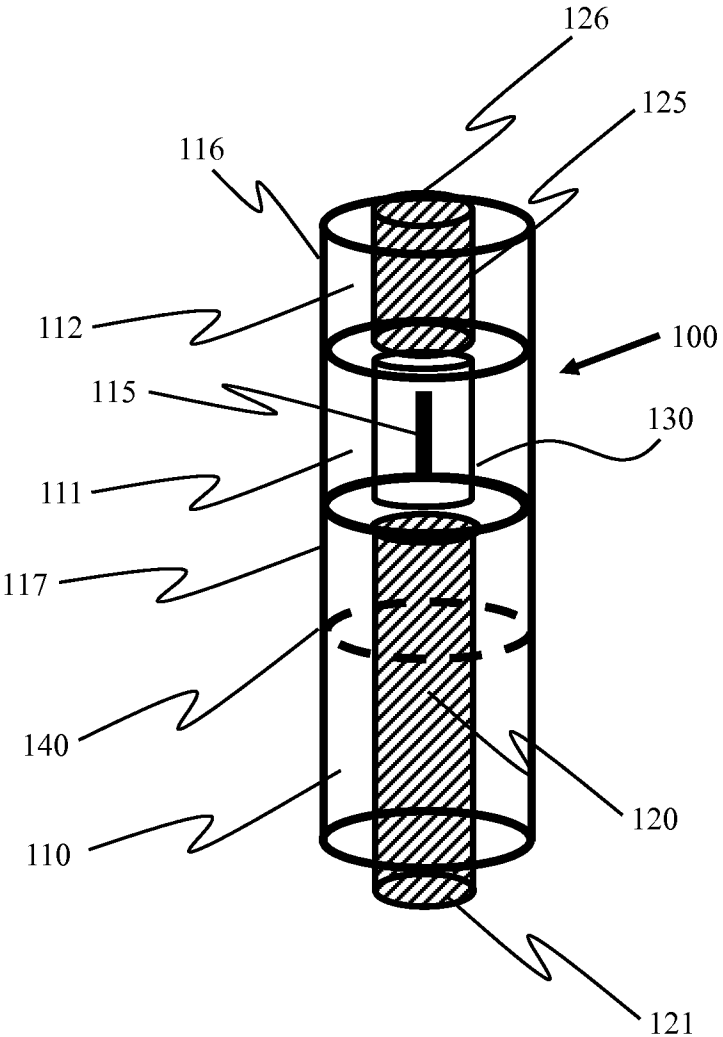

FIG. 8B is a side-cut view of an integrated bulb/output coupling-element assembly 100 shown in FIG. 8A. This diagram is merely an example, which should not unduly limit the scope of the claims herein. One of ordinary skill in the art would recognize other variations, modifications, and alternatives. The assembly can be made from a single piece of material such as a hollow quartz tube or translucent alumina, or it can be made from three different pieces and assembled together.

Figure 8D:
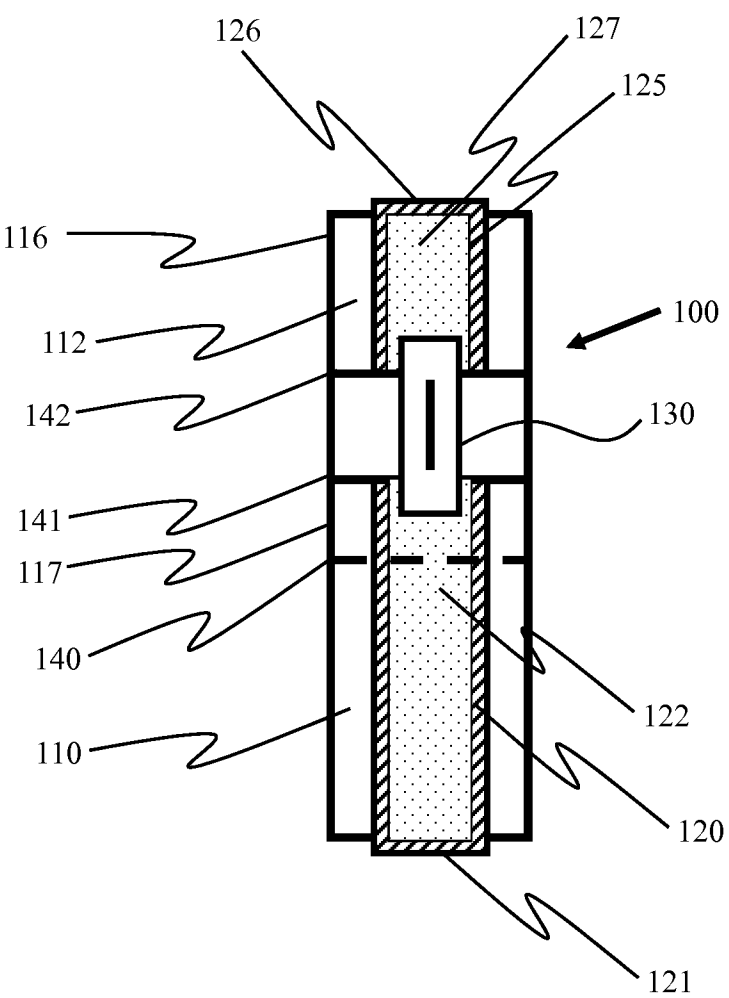
Figure 8C:
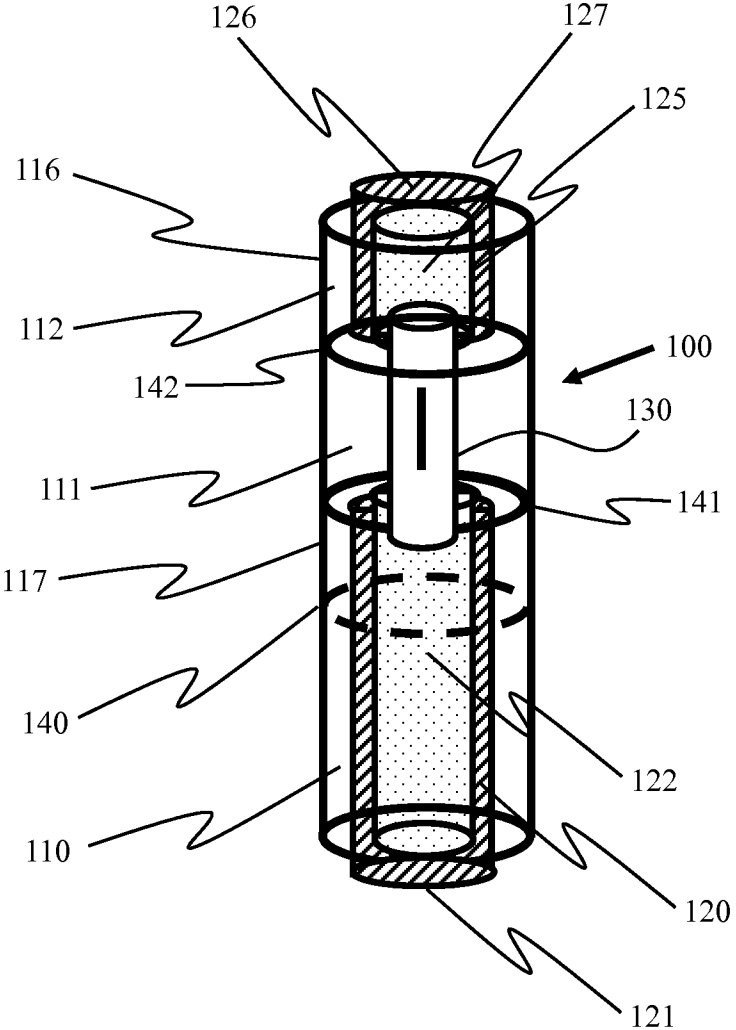

FIG. 8C is a perspective view of an alternative design for an integrated bulb/output coupling-element assembly 100. This diagram is merely an example, which should not unduly limit the scope of the claims herein. One of ordinary skill in the art would recognize other variations, modifications, and alternatives. The assembly is similar to FIG. 8A except that the output coupling-element 120 and top coupling-element 125 are made using a conductive coated dielectric instead of a solid conductor. The bulb assembly comprises three sections 110, 111, and 112 which can be made separately from different materials and integrated together or can be made from a single piece such as a hollow tube of quartz or translucent alumina. The output coupling-element 120 consists of a dielectric post 122 made from a material such as alumina with its outer surface coated with a conductive veneer such as silver. The body 110 is bored to receive the output coupling-element 120. The top coupling-element 125 also consists of a dielectric post 127 made from a material such as alumina with its outer surface coated with a conductive veneer such as silver. It is a key invention that dielectric posts of the output coupling-element 120 and top coupling-element 125 are bored to closely receive bulb 130, such that heat transfer through their dielectric centers and RF coupling through their conductive outer coatings take place simultaneously. The areas of the dielectric posts of output coupling-element and top coupling-element that come in contact with the bulb are not covered with a conductive veneer. Using this bulb assembly approach the high RF fields are kept away from the ends of bulbs resulting in a more reliable lamp. It is also a key aspect of this invention that output coupling-element 120 and top coupling-element 125 make ground contact at planes 121 and 126 respectively with the lamp body 600 depicted in FIGS. 7A, 7B, and 7C.

The portion of body 110 that is received by the lamp body 600 as depicted in FIGS. 7A, 7B, and 7C (and overlaps with the length of input coupling-element 630) and is shown in FIG. 8C as being below the dashed line 140; is not coated with a conductive layer. The portion of body 110 that is above the lamp body 600 but substantially below the bulb 130 is depicted schematically as the area between 140 and 141; this portion may be coated with a conductive veneer. The portion of body 110 that is substantially above the bulb 130 is depicted as that area above line 142; this portion may also be coated with a conductive veneer 116. The purpose of the conductive coatings is to shield against unwanted electromagnetic radiation. An example embodiment of conductive veneers 116 and 117 is silver paint. Alternatively, instead of conductive veneers portion of the lower section 110 can be covered by a metal ring 650 as part of the extension of lamp body 600 as depicted in FIG. 9. The outer surface of the mid section 111 is not coated.

FIG. 8D is a side-cut view of an integrated bulb/output coupling-element assembly 100 shown in FIG. 8C. This diagram is merely an example, which should not unduly limit the scope of the claims herein. One of ordinary skill in the art would recognize other variations, modifications, and alternatives. The assembly can be made from a single piece of material such as a hollow quartz tube or translucent alumina, or it can be made from three different pieces and assembled together.

Figure 8F:
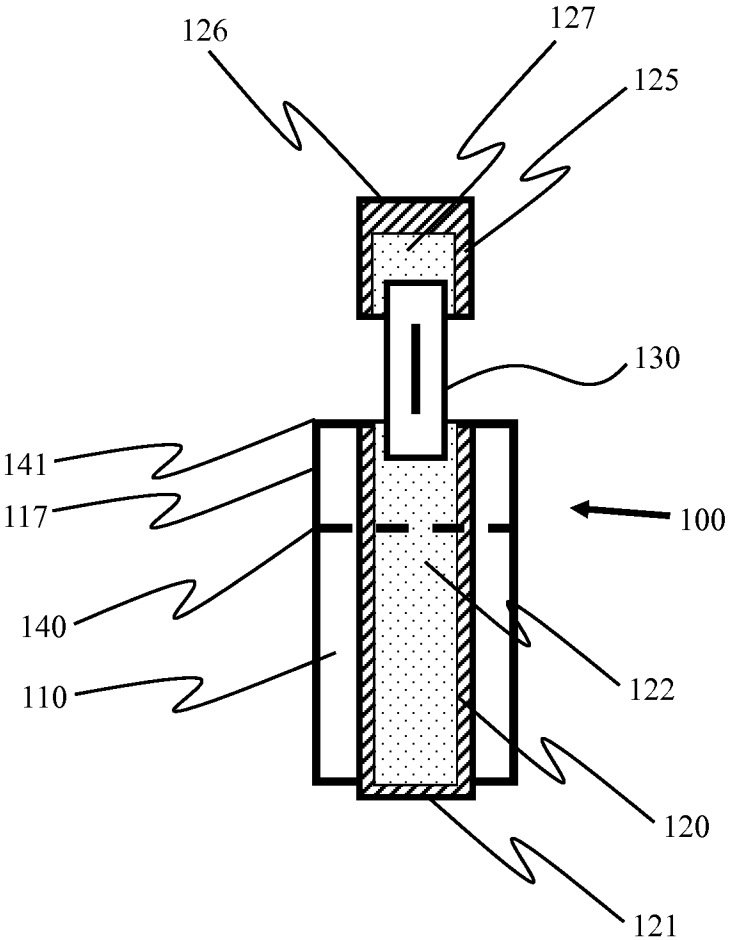
Figure 8E:
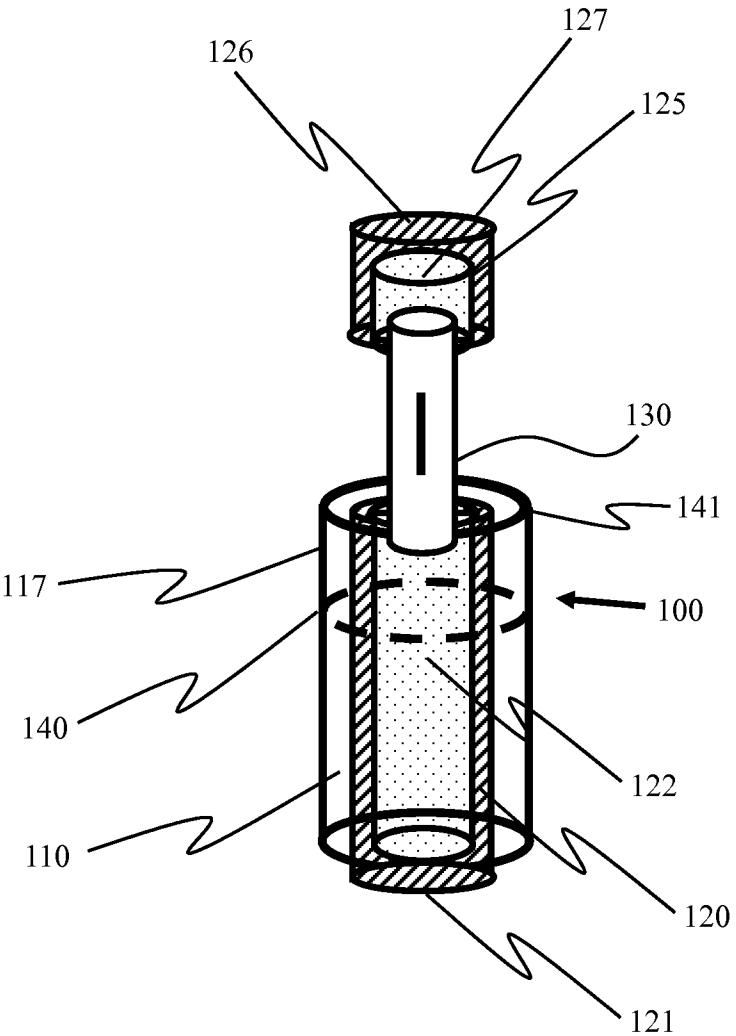

FIG. 8E is a perspective view of an alternative design for an integrated bulb/output coupling-element assembly 100. This diagram is merely an example, which should not unduly limit the scope of the claims herein. One of ordinary skill in the art would recognize other variations, modifications, and alternatives. The assembly is similar to FIG. 8C except that the middle section and top section of the assembly are not inside a dielectric tube such as a quartz tube. The assembly consists of three sections. The bottom section 110 is identical to FIG. 8C and it contains the output coupling-element 120 which consists of a dielectric post 122 made from a material such as alumina with its outer surface coated with a conductive veneer such as silver. The middle section consists of the bulb (gas-fill vessel) 130 which is made from a material that is transparent to visible light such as quartz or translucent alumina. The top section consists of the top coupling-element 125 which also consists of a dielectric post 127 made from a material such as alumina with its outer surface coated with a conductive veneer such as silver. It is a key invention that dielectric posts of the output coupling-element 120 and top coupling-element 125 are bored to closely receive bulb 130, such that heat transfer through their dielectric centers and RF coupling through their conductive outer coatings take place simultaneously. The areas of the dielectric posts of output coupling-element and top coupling-element that come in contact with the bulb are not covered with a conductive veneer. Using this bulb assembly approach the high RF fields are kept away from the ends of bulbs resulting in a more reliable lamp. It is also a key aspect of this invention that output coupling-element 120 and top coupling-element 125 make ground contact at planes 121 and 126 respectively with the lamp body 600 depicted in FIGS. 7A, 7B, and 7C.

The portion of body 110 that is received by the lamp body 600 as depicted in FIGS. 7A, 7B, and 7C (and overlaps with the length of input coupling-element 630) and is shown in FIG. 8E as being below the dashed line 140; is not coated with a conductive layer. The portion of body 110 that is above the lamp body 600 but substantially below the bulb 130 is depicted schematically as the area between 140 and 141; this portion may be coated with a conductive veneer 117. The purpose of the conductive coatings is to shield against unwanted electromagnetic radiation. An example embodiment of conductive veneers 117 is silver paint. Alternatively, instead of conductive veneers portion of the lower section 110 can be covered by a metal ring 650 as part of the extension of lamp body 600 as depicted in FIG. 9.

FIG. 8F is a side-cut view of an integrated bulb/output-element assembly 100 shown in FIG. 3D. This diagram is merely an example, which should not unduly limit the scope of the claims herein. One of ordinary skill in the art would recognize other variations, modifications, and alternatives. It is similar to the assembly shown in FIG. 8E except that the middle and top sections of the assembly are not within a dielectric tube made from a material such as quartz.

Figure 8H:
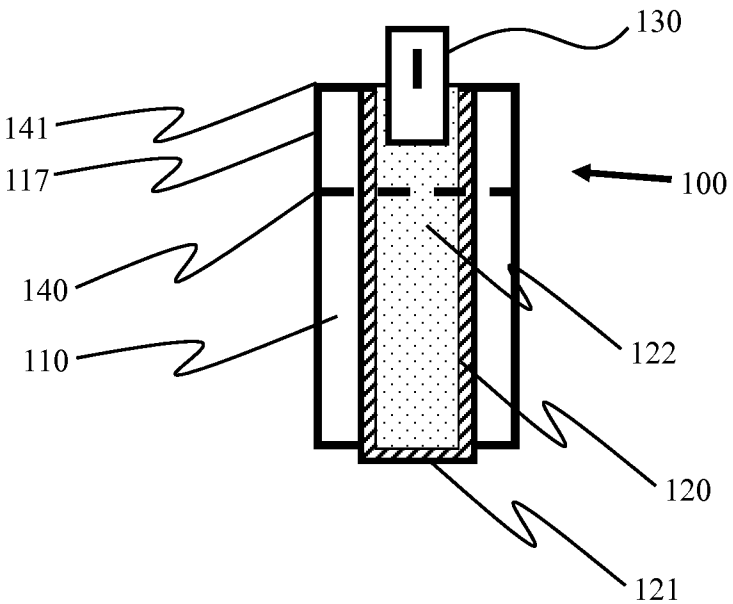
Figure 8G:
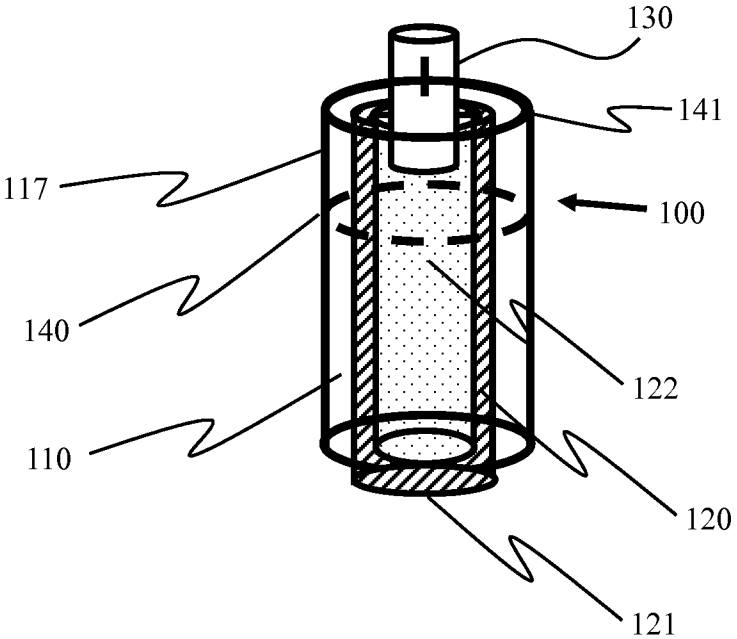

FIG. 8G is a perspective view of an alternative design for an integrated bulb/output coupling-element assembly 100. This diagram is merely an example, which should not unduly limit the scope of the claims herein. One of ordinary skill in the art would recognize other variations, modifications, and alternatives. The assembly is similar to FIG. 8E except that there is no top coupling-element. The assembly consists of two sections. The bottom section 110 is identical to FIG. 8E and it contains the output coupling-element 120 which consists of a dielectric post 122 made from a material such as alumina with its outer surface coated with a conductive veneer such as silver. The top section consists of the bulb (gas-fill vessel) 130 which is made from a material that is transparent to visible light such as quartz or translucent alumina. It is a key aspect of the invention that dielectric post of the output coupling-element 120 is bored to closely receive bulb 130, such that heat transfer through its dielectric center and RF coupling through its conductive outer coating take place simultaneously. The area of the dielectric post of the output coupling-element that come in contact with the bulb is not covered with a conductive veneer. Using this bulb assembly approach the high RF fields is kept away from the end of bulb resulting in a more reliable lamp. It is also a key aspect of this invention that output coupling-element 120 makes ground contact at plane 121 with the lamp body 600 depicted in FIGS. 2A, 2B, and 2C.

The portion of body 110 that is received by the lamp body 600 as depicted in FIGS. 7A, 7B, and 7C (and overlaps with the length of input coupling-element 630) and is shown in FIG. 8G as being below the dashed line 140; is not coated with a conductive layer. The portion of body 110 that is above the lamp body 600 but substantially below the bulb 130 is depicted schematically as the area between 140 and 141; this portion may be coated with a conductive veneer 117. The purpose of the conductive coatings is to shield against unwanted electromagnetic radiation. An example embodiment of conductive veneer 117 is silver paint. Alternatively, instead of a conductive veneer, portion of the body 110 between 140 and 141 can be covered by a metal ring 650 as part of the extension of lamp body 600 as depicted in FIG. 9.

FIG. 8H is a side-cut view of an integrated bulb/output coupling-element assembly 100 shown in FIG. 8G. This diagram is merely an example, which should not unduly limit the scope of the claims herein. One of ordinary skill in the art would recognize other variations, modifications, and alternatives. The assembly is similar to FIG. 8F except that there is no top coupling-element.

FIG. 9 is a perspective view of the lamp body/metallic enclosure of the lamp shown in FIGS. 7A, 7B, and 7C. This diagram is merely an example, which should not unduly limit the scope of the claims herein. One of ordinary skill in the art would recognize other variations, modifications, and alternatives. The lamp body/metallic enclosure consists of two sections a bottom section 600 and a top section 650. The bottom section of the lamp body is cylindrical in this case but it also can be made in rectangular or other shapes as well. The top portion of the lamp body is in the form of a metallic ring but it can be in the form of a rectangle/square as well. The lamp body is made from a metal such as aluminum or copper. The lamp body can be made from multiple pieces and attached together using screws or by soldering or welding or other techniques. Inside of the lamp body 638 is hollow and it receives the integrated bulb/output coupling-element assembly 100 (FIGS. 8A, 8C, and 8E) through holes 610 and 510. The output coupling-element 120 and top coupling-element 125 are electrically connected to the lamp body which is connected to ground. There are also holes in the lamp body 611 and 612 to receive the input coupling-element 630 and the feedback coupling-element 635 shown in FIGS. 7A, 7B, and 7C. The two coupling-elements will not touch the walls of lamp body at the bottom. However, the input coupling-element 630 will protrude through the hole 731 at the top surface of lamp body 600 and connects to the lamp body which is connected to ground.

Figure 10A:
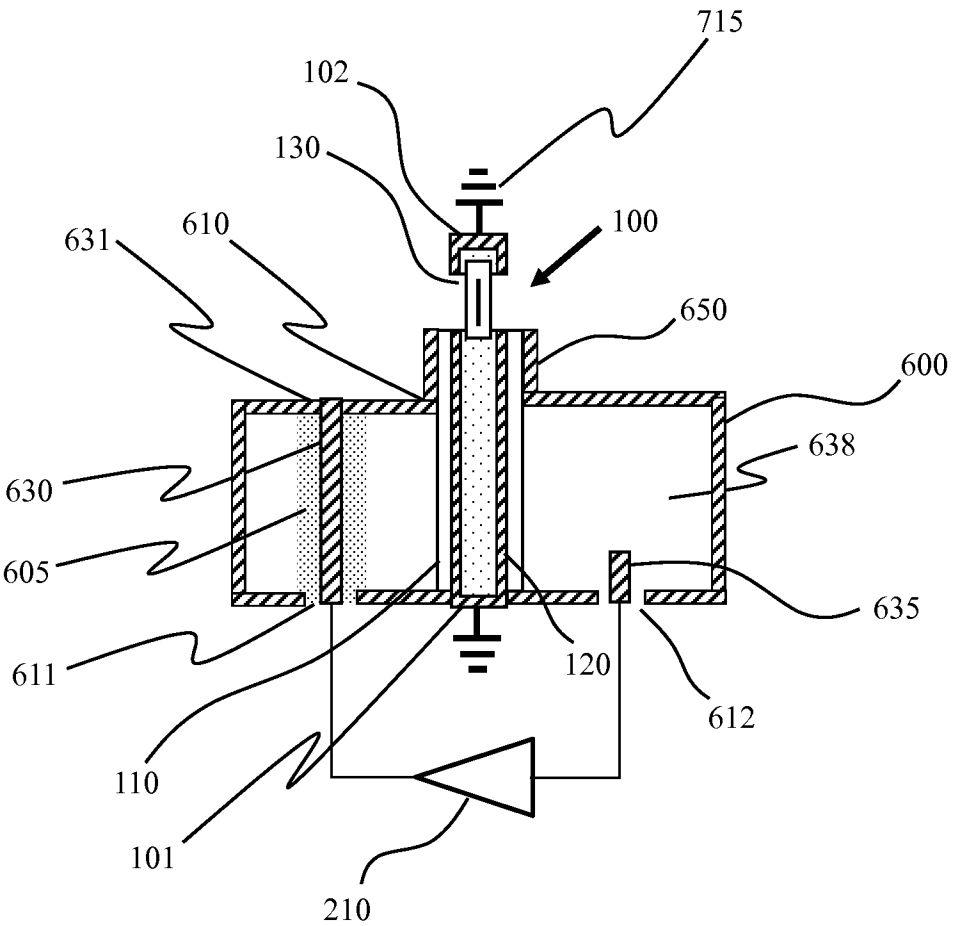

FIG. 10A is a side cut view of an alternate electrodeless lamp design, employing the lamp body/metallic enclosure shown in FIG. 9 and the integrated bulb/output coupling-element assembly shown in FIG. 8E. This diagram is merely an example, which should not unduly limit the scope of the claims herein. One of ordinary skill in the art would recognize other variations, modifications, and alternatives. The inside of lamp body 638 is substantially hollow. A dielectric layer 605 such as Teflon is used around the input coupling-element 630 to prevent arcing. The end of the input coupling-element 631 is connected to the lamp body which is connected to ground. The lamp assembly is also connected to ground at planes 101 and 102. The lower section of the lamp assembly 110 which is inside lamp body 600 is not covered with any metal. This allows RF energy to be coupled from the input coupling-element 630 to the output coupling-element 120. The coupling and the impedance match to the bulb depends on the separation between the two coupling-elements and their dimensions including length and diameter. The resonant frequency of the lamp body and lamp assembly is strongly dependent on the length of the output coupling-element and is less dependent on the diameter of the cylindrical lamp body. Feedback coupling-element 635 is closely received by the lamp body 600 through opening 612, and as such is not in direct DC electrical contact with the lamp body 600. The shorter feedback E-field coupling-element 635 couples a small amount of RF energy from the bulb/coupling-element assembly 100 and provides feedback to the RF amplifier 210. While the configuration shown in FIG. 10A is a feedback configuration similar to FIG. 7A it is also possible to implement this design using a no-feedback configuration similar to FIG. 2B.

Figure 10B:
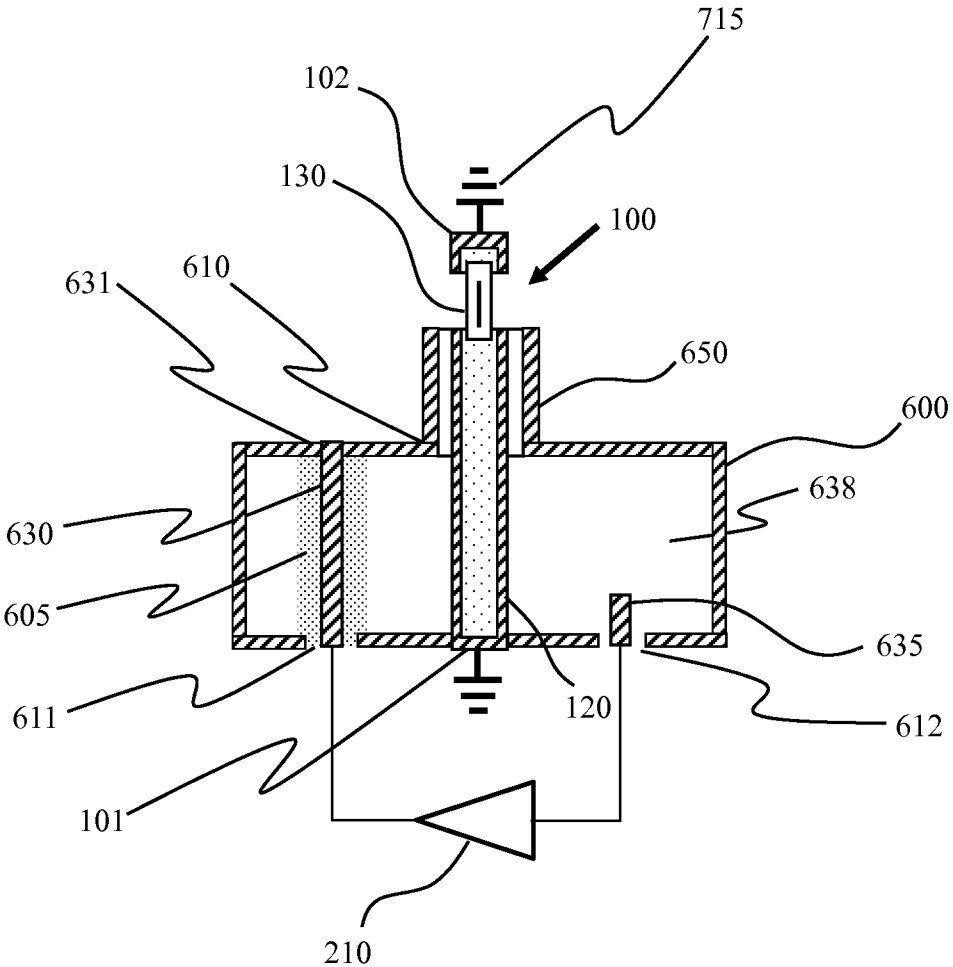

FIG. 10B is a side cut view of an alternate electrodeless lamp design to the one shown in FIG. 10A. This diagram is merely an example, which should not unduly limit the scope of the claims herein. One of ordinary skill in the art would recognize other variations, modifications, and alternatives. This design is similar except part of the dielectric layer 110 (such as a quartz tube) shown in FIG. 10A surrounding the output coupling-element 120 inside the bottom section of the lamp body 600 has been removed.

Figure 10C:
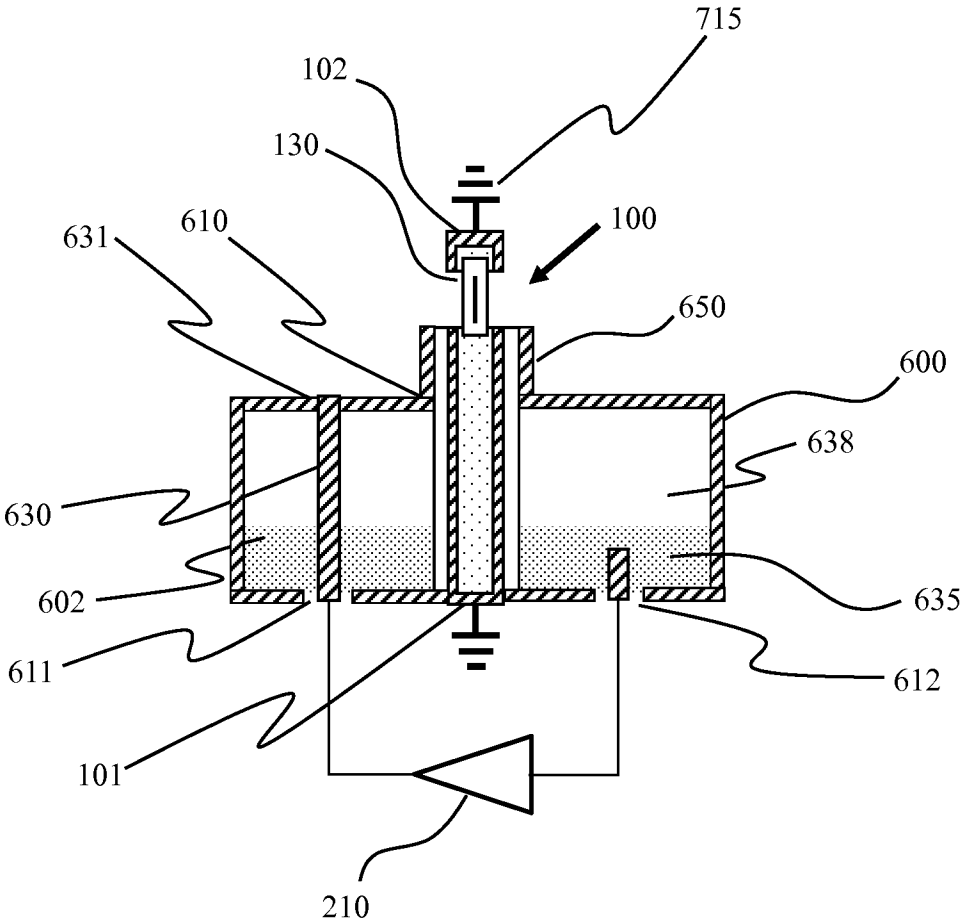

FIG. 10C is a side cut view of an alternate electrodeless lamp design to the one shown in FIG. 10A. This diagram is merely an example, which should not unduly limit the scope of the claims herein. One of ordinary skill in the art would recognize other variations, modifications, and alternatives. This design is similar except that the lamp body 600 is partially filled with dielectric 602 in the lower part of the lamp body.

Figure 10D:
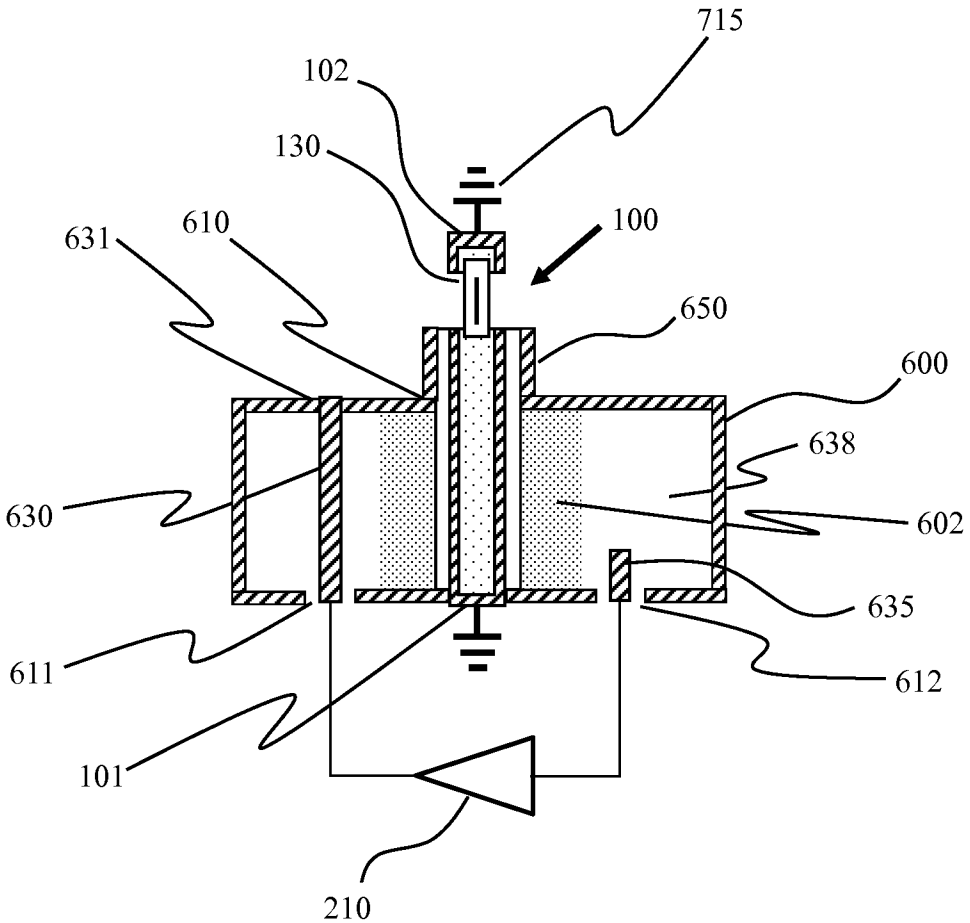

FIG. 10D is a side cut view of an alternate lamp design to the one shown in FIG. 10C. This diagram is merely an example, which should not unduly limit the scope of the claims herein. One of ordinary skill in the art would recognize other variations, modifications, and alternatives. This design also has a lamp body 600 that is partially filled with dielectric except in this case the dielectric layer is cylindrical surrounding the output coupling-element of lamp assembly. It is also possible that the lamp body is completely filled with a dielectric.

It is shown through electromagnetic simulation that the two significant advantages of the lamp design depicted in FIGS. 7A and 7B—namely, that the resonant frequency is strongly dependent on the relative lengths of the input and output coupling-elements while being very weakly dependent on the dimensions or dielectric properties of the lamp body 600 or its dielectric insert 602, and that the RF power coupled to the bulb 130 is strongly dependent on the physical separation between the input coupling-element 630 and the output coupling-element within the bulb/output coupling-element assembly 100—are retained in the design depicted in FIGS. 9A and 9B. It can also be appreciated by one of ordinary skill in the art that the distributed RF oscillator configuration depicted in FIGS. 9A and 9B—involving a feedback coupling-element 635, and amplifier 210, and an input coupling-element 630 forming a positive feedback loop around the bulb/output coupling-element assembly 100, similar to that configuration depicted in FIG. 7A—can be substituted with the lumped RF source configuration depicted in FIG. 7B with no substantive change to the invention.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. A shock resistant outdoor lamp comprising a lamp apparatus, the lamp apparatus comprising:

a housing having an inner region and an outer region, an inner cavity formed from the inner region;

a reflector provided within a portion of the inner region;

an RF source disposed within the inner cavity, the RF source being coupled to an AC source;

a bulb assembly coupled to the RF source, the bulb assembly comprising:

a base member, the base member having an outer region capable of being coupled to first AC potential and an inner region capable of being coupled to a second AC potential;

a support body coupled to the base member;

a mechanical shock resistant gas filled vessel having a transparent or translucent body having an inner surface and an outer surface and a sealed cavity formed within the inner surface, the gas filled vessel comprising a first end region and a second end region;

a length provided between the first end region and the second end region and ranging from about 1 millimeter to about 15 millimeters to characterize the gas filled vessel;

a thickness of at least about 0.5 millimeters characterizing a distance between the inner surface and the outer source of the transparent or translucent body;

at least one or more coupling members operably coupled to the gas filled vessel such that the outer surface of the gas filled vessel is substantially free from mechanical damage caused with the one or more coupling members and substantially free from any openings in the thickness, wherein the one or more coupling members include:

a first coupling-element spatially disposed within the conductive housing coupled to the first end region of the gas-filled vessel, the other end of the first coupling-element being electrically connected to the conductive housing;

an RF source coupling-element spatially disposed within the conductive housing and within a predetermined distance from the first coupling-element, a first end of the RF source coupling-element being electrically connected to the conductive housing, a second end of the RF source coupling-element comprising an input; and a gap provided between the RF source coupling-element and the first coupling-element, the gap provided by the predetermined distance;

an output of the RF source being coupled to the first coupling-element through the gap and the RF source coupling-element, the output of the RF source being coupled to the input of the RF source coupling-element;

a transparent cover comprising a polycarbonate material, the transparent cover being capable of withstanding an impact of a bullet fired from a firearm having a caliber of 22 caliber and greater or one or more shots fired from a shot gun of at least 12 gauge; and a supporting member coupled the housing, the supporting member having a vertical height of greater than fifteen feet.

2. The lamp apparatus of claim 1 wherein the transparent cover is shock resistant.

3. The lamp apparatus of claim 1 wherein the gas filled vessel is about less than 10 percent in spatial size as compared to a conventional sodium lamp bulb that has a length of about six inches and a width of about three inches.

4. The lamp apparatus of claim 1 wherein the shock resistant gas filled vessel comprises the transparent or translucent body characterized by a continuous thickness of material to define the sealed cavity.

5. The lamp apparatus of claim 1 wherein the sealed cavity comprises argon.

6. The lamp apparatus of claim 1 wherein the transparent cover is a bullet proof material including polycarbonate.

7. The lamp apparatus of claim 1 wherein the reflector comprises one or more portions partially enclosing the bulb assembly.

8. The lamp apparatus of claim 1 wherein the reflector is made of a metal material.

9. The lamp apparatus of claim 1 wherein the bulb assembly is substantially mechanical shock proof, the bulb assembly comprising the shock proof gas filled bulb being free from one or more internal electrodes and being substantially free from any external mechanical stress or strain.

10. The lamp apparatus of claim 1 wherein the bulb assembly is substantially shock proof, the bulb assembly comprising the shock proof gas filled bulb being free from one or more internal electrodes.

11. A shock resistant outdoor lamp comprising a lamp apparatus, the lamp apparatus comprising:

a housing having an inner region and an outer region, an inner cavity formed from the inner region;

a reflector provided within a portion of the inner region;

an RF source disposed within the cavity, the RF source being coupled to an AC source;

a bulb assembly coupled to the RF source, the bulb assembly comprising:

a base member, the base member having an outer region capable of being coupled to first AC potential and an inner region capable of being coupled to a second AC potential;

a support body coupled to the base member;

a mechanical shock resistant gas filled vessel having a transparent or translucent body having an inner surface and an outer surface and a cavity formed within the inner surface, the gas filled vessel comprising a first end region, a second end region, and the length defined between the first end region and the second end region; the length ranging from about 3 millimeters to about 15 millimeters characterizing the gas filled vessel;

a thickness of at least about 0.5 millimeter characterizing a distance between the inner surface and the outer source of the transparent or translucent body;

at least one or more coupling members operably coupled to the gas filled vessel such that the outer surface of the gas filled vessel is substantially free from mechanical damage caused with the one or more coupling members and substantially free from any openings in the thickness, wherein the one or more coupling members include:

a first coupling-element spatially disposed within the conductive housing coupled to the first end region of the gas-filled vessel, the other end of the first coupling-element being electrically connected to the conductive housing;

an RF source coupling-element spatially disposed within the conductive housing and within a predetermined distance from the first coupling-element, a first end of the RF source coupling-element being electrically connected to the conductive housing, a second end of the RF source coupling-element comprising an input; and a gap provided between the RF source coupling-element and the first coupling-element, the gap provided by the predetermined distance;

an output of the RF source being coupled to the first coupling-element through the gap and the RF source coupling-element, the output of the RF source being coupled to the input of the RF source coupling-element; and a supporting member coupled the housing, the supporting member having a vertical height of greater than fifteen feet.

12. The lamp apparatus of claim 11 further comprising a transparent cover comprising a polycarbonate material, the transparent cover being capable of withstanding an impact of a bullet from at least a 22 caliber gun and greater.

13. The lamp apparatus of claim 12 wherein the transparent cover is shock resistant; wherein the gas filled vessel is less than about 10 percent in spatial size as compared to a conventional sodium lamp bulb that has a length of about six inches and a width of about three inches; wherein the shock resistant gas filled vessel comprises the transparent or translucent body characterized by a continuous thickness of material to define the cavity.

14. The lamp apparatus of claim 11 wherein the cavity comprises argon.

15. The lamp apparatus of claim 12 wherein the transparent cover is a material known as Plexiglas™.

16. The lamp apparatus of claim 11 wherein the reflector comprises one or more portions partially enclosing the bulb assembly, wherein the reflector is made of a metal material.

17. The lamp apparatus of claim 11 wherein the bulb assembly is substantially shock proof, the bulb assembly comprising the shock proof gas filled bulb being free from one or more internal electrodes.

18. The lamp apparatus of claim 11 wherein the bulb assembly is substantially shock proof, the bulb assembly comprising the shock proof gas filled bulb being free from one or more internal electrodes and being substantially free from any external mechanical stress or strain.

19. A shock resistant outdoor lamp comprising a lamp apparatus, the lamp apparatus comprising:

a housing having an inner region and an outer region, an inner cavity formed from the inner region;

a reflector provided within a portion of the inner region;

a bulb assembly coupled to an RF source RF coupled to an AC source, the bulb assembly comprising:

a base member, the base member having an outer region capable of being coupled to first AC potential and an inner region capable of being coupled to a second AC potential;

a support body coupled to the base member;

a mechanical shock resistant gas filled vessel having a transparent or translucent body having an inner surface and an outer surface and a cavity formed within the inner surface, the gas filled vessel comprising a first end region, a second end region, and the length defined between the first end region and the second end region;

a length ranging from about 0.5 centimeter to about three centimeters characterizing the gas filled vessel;

a thickness of at least about 1 millimeter characterizing a distance between the inner surface and the outer source of the transparent or translucent body;

at least one or more coupling members operably coupled to the gas filled vessel such that the outer surface of the gas filled vessel is substantially free from mechanical damage caused with the one or more coupling members and substantially free from any openings in the thickness, wherein the one or more coupling members include:

a first coupling-element spatially disposed within the conductive housing coupled to the first end region of the gas-filled vessel, the other end of the first coupling-element being electrically connected to the conductive housing;

an RF source coupling-element spatially disposed within the conductive housing and within a predetermined distance from the first coupling-element, a first end of the RF source coupling-element being electrically connected to the conductive housing, a second end of the RF source coupling-element comprising an input; and a gap provided between the RF source coupling-element and the first coupling-element, the gap provided by the predetermined distance;

an output of the RF source being coupled to the first coupling-element through the gap and the RF source coupling-element, the output of the RF source being coupled to the input of the RF source coupling-element; and a supporting member coupled the housing, the supporting member configured to a vertical height of greater than fifteen feet.

* * * * *